US008657353B2

(12) United States Patent
Frey et al.

(10) Patent No.: US 8,657,353 B2
(45) Date of Patent: Feb. 25, 2014

(54) AUTO DEPLOYED CARGO LOADING RAIL SYSTEM AND MEDIC SEAT IN-TRUCK TRAVEL RAIL

(75) Inventors: David C. Frey, Traverse City, MI (US); Jay W. Winborn, Berkley, MI (US); Linda G. Tucker, Starkville, MS (US); William K. Fletcher, Richmond, MI (US)

(73) Assignee: Milton Manufacturing, Inc., Detroit, MI (US)

( * ) Notice: Subject to any disclaimer, the term of this patent is extended or adjusted under 35 U.S.C. 154(b) by 148 days.

(21) Appl. No.: 13/230,929

(22) Filed: Sep. 13, 2011

(65) Prior Publication Data

US 2012/0062009 A1 Mar. 15, 2012

Related U.S. Application Data

(60) Provisional application No. 61/382,275, filed on Sep. 13, 2010.

(51) Int. Cl.
*A61G 1/02* (2006.01)

(52) U.S. Cl.
USPC ..... 296/20

(58) Field of Classification Search
USPC ..... 296/19, 20, 26.03, 26.06, 24.38
IPC ..... A61G 1/02
See application file for complete search history.

(56) References Cited

U.S. PATENT DOCUMENTS

| | | | | |
|---|---|---|---|---|
| 1,609,253 | A * | 11/1926 | Hummert | 296/19 |
| 2,347,002 | A * | 4/1944 | Schofield | 296/16 |
| 5,518,288 | A * | 5/1996 | Deklotz | 296/26.06 |
| 7,073,216 | B2 * | 7/2006 | Schwingeler et al. | 5/118 |
| 7,328,926 | B1 * | 2/2008 | Myers et al. | 296/19 |
| 2011/0115245 | A1 * | 5/2011 | Engelbrecht et al. | 296/19 |

* cited by examiner

*Primary Examiner* — Glenn Dayoan
*Assistant Examiner* — Pinel Romain
(74) *Attorney, Agent, or Firm* — Harness, Dickey & Pierce, P.L.C.

(57) ABSTRACT

A vehicle cargo loading rail system includes inner vehicle rail portions connected to vehicle structure. Connecting rail portions have a rotatable connecting joint to rotatably connect the connecting rail portions to one of the inner vehicle rail portions. Step mounted rail portions are connected to a door rotatably connected to the vehicle and rotatable between closed and open conditions. The step mounted rail portions have a longitudinal slot. A roller fitting assembly is connected to the connecting rail portions and slidably received in the longitudinal slot. A trolley member is movable on a continuous rail surface created when the door is open having vehicle rail portion ends contacting connecting rail portion first ends, and connecting rail portion second ends in contact with step mounted rail portion ends. A trolley member cavity receives a support post of a member loaded into the vehicle by movement on the continuous rail surface.

17 Claims, 28 Drawing Sheets

AUTO DEPLOYED CARGO LOADING RAIL SYSTEM AND MEDIC SEAT IN-TRUCK TRAVEL RAIL

CROSS-REFERENCE TO RELATED APPLICATIONS

This application claims the benefit of U.S. Provisional Application No. 61/382,275 filed on Sep. 13, 2010. The entire disclosure of the above application is incorporated herein by reference.

FIELD

The present disclosure relates to cargo loading rail systems used to load items into vehicles.

BACKGROUND

This section provides background information related to the present disclosure which is not necessarily prior art.

Vehicles such as military ambulances are commonly converted for use as ambulances from more general purpose vehicles. For this reason, the height to the vehicle floor from a ground level may be significant and can hinder loading of a litter supporting a wounded soldier. Loading of wounded soldiers is also commonly accomplished under enemy fire and therefore must be accomplished in a rapid time frame. The combination of the height that the litter must be lifted to and the limited time frame to accomplish this render converted vehicles undesirable for ambulance use. Converted vehicles commonly do not include any system providing assistance during litter loading, leaving this function entirely up to the physical strength of other military personnel, which can further endanger these personnel when under enemy fire.

SUMMARY

This section provides a general summary of the disclosure, and is not a comprehensive disclosure of its full scope or all of its features.

According to several embodiments, a cargo loading rail system for a vehicle includes first and second inner vehicle rail portions connected to the structure of a vehicle and oriented parallel to each other. First and second connecting rail portions individually have a rotatable connecting joint to rotatably connect the first and second connecting rail portions to one of the first and second inner vehicle rail portions. First and second step mounted rail portions are each connected to a door rotatably connected to the vehicle. The door is rotatable between each of a fully closed and a fully open condition. Each of the first and second step mounted rail portions further have a longitudinal slot. A roller fitting assembly connected to each of the first and second connecting rail portions is positioned opposite to the connecting joint. The roller fitting assembly is slidably received in the longitudinal slot of each of the first and second step mounted rail portions. At least one trolley member is movable on a continuous rail surface created when the door is in the fully open condition having ends of the first and second connecting rail portions in contact with first ends of the first and second connecting rail portions, and second ends of the first and second connecting rail portions in contact with ends of the step mounted rail portions. The at least one trolley member has a cavity receiving a support post of a member to be loaded into the vehicle by movement of the at least one trolley member on the continuous rail surface.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
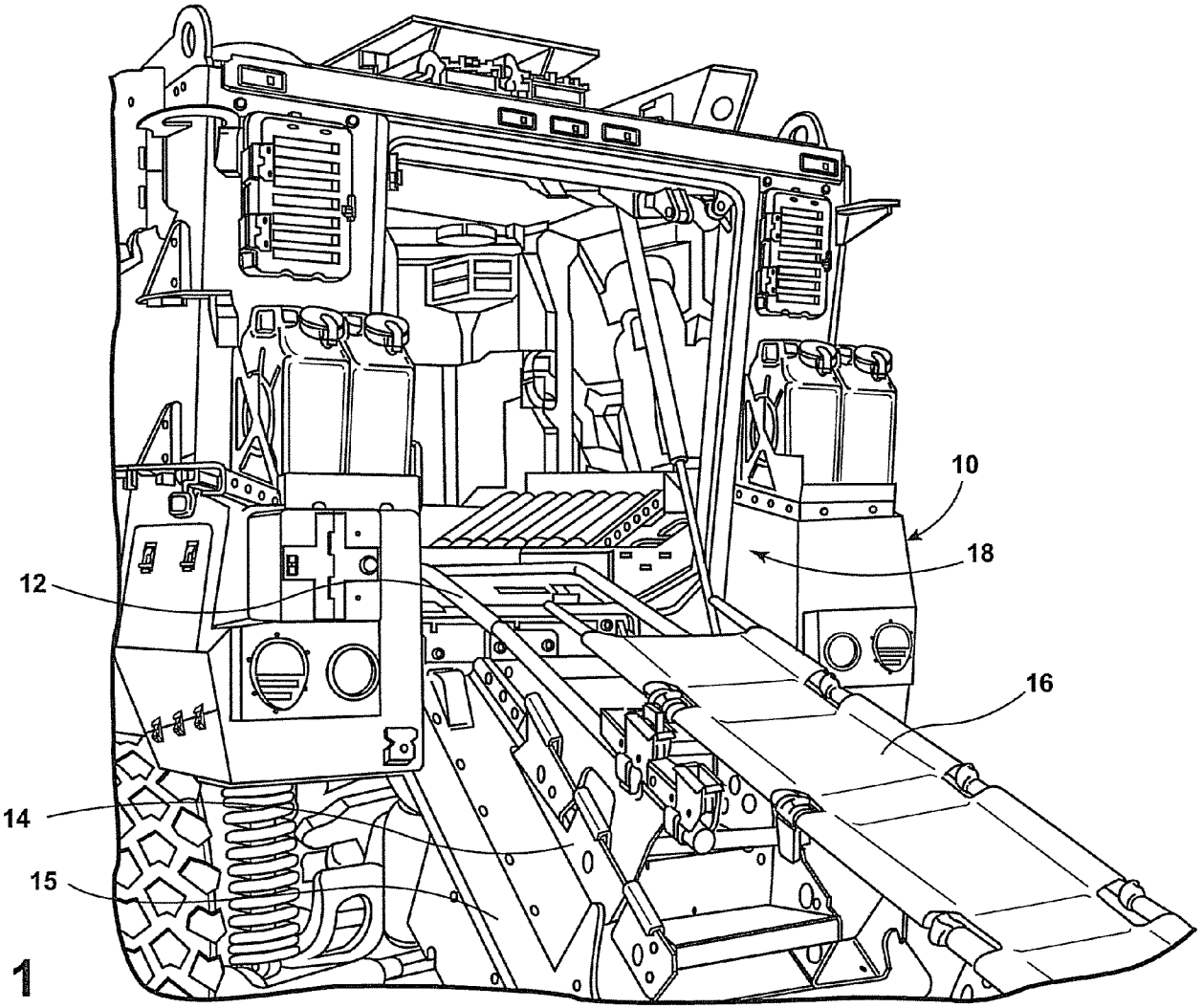
FIG. 1 is a rear left perspective view looking forward of an ambulance vehicle having cargo loading rail system and medic seat in-truck travel rail of the present disclosure.

Example embodiments will now be described more fully with reference to the accompanying drawings.

Example embodiments are provided so that this disclosure will be thorough and will fully convey the scope to those who are skilled in the art. Numerous specific details are set forth, such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring to FIG. 1, a vehicle 10 is shown having an automatically deployed cargo loading rail system 12 of the present disclosure in a fully deployed position. Cargo loading rail system 12 is connected to a step assembly 14 which is mounted to an inner wall of a rearwardly rotatable door 15 of vehicle 10. According to several embodiments vehicle 10 is converted for use as an ambulance, and loading rail system 12 is used to load injured persons such as soldiers in battle areas. A person carrying litter 16 is shown in a first engaged position with cargo loading rail system 12 prior to sliding displacement of litter 16 into a vehicle cargo bay 18 of vehicle 10.

Figure 2:
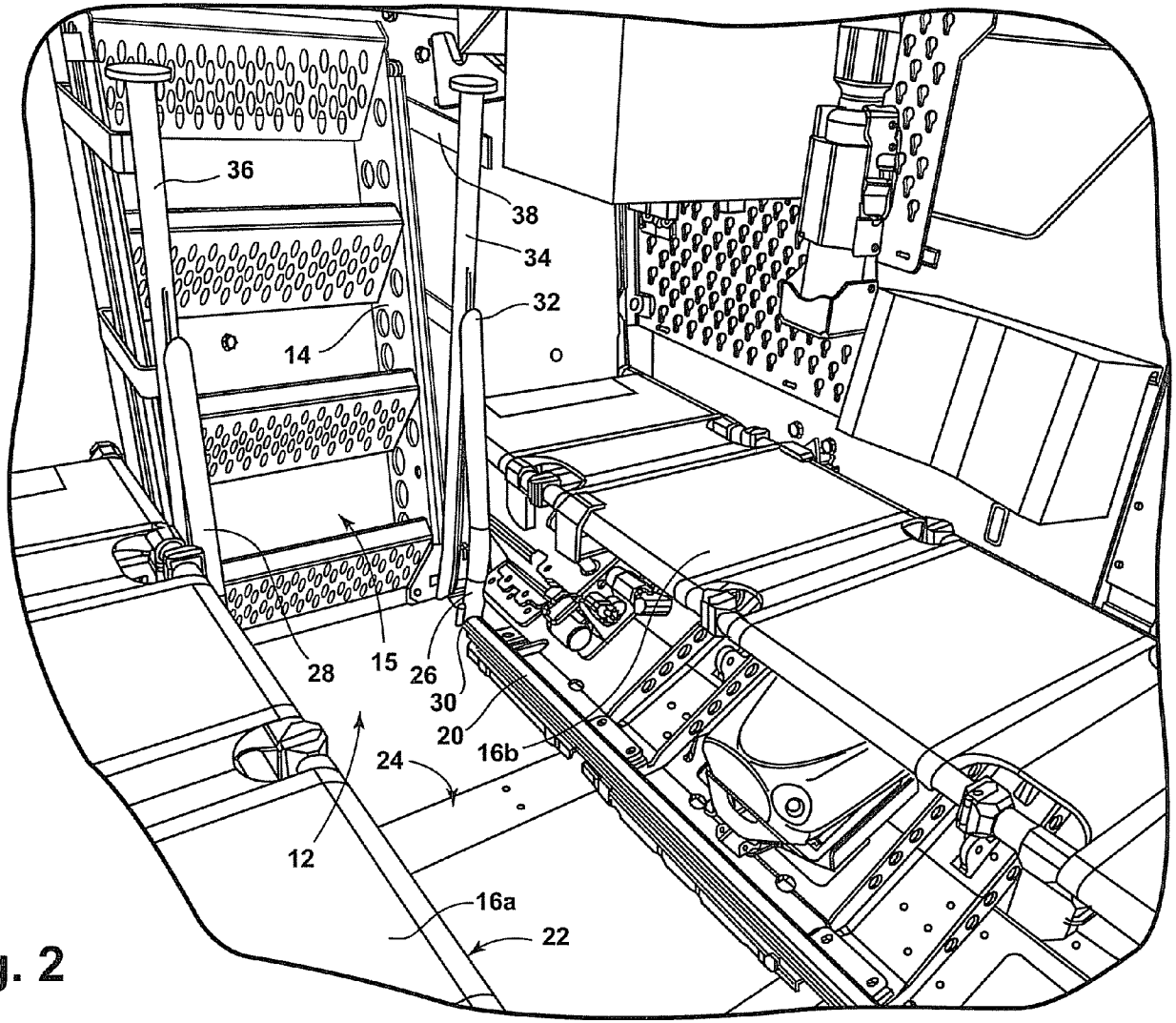
FIG. 2 is a rear left perspective view looking rearward from an interior of the ambulance vehicle of FIG. 1.

Referring to FIG. 2, an interior of vehicle 10 is shown looking rearward toward door 15 with door 15 in a fully upright and closed condition. First and second litters 16*a*, 16*b* are shown after loading using cargo loading rail system 12 and subsequent repositioning to their vehicle outboard stowed positions. Cargo loading rail system 12 includes first and second inner vehicle rail portions 20, 22 (second inner vehicle rail portion 22 is only partially visible in this view), which are connected to a vehicle floor 24, for example by fastening. First and second inner vehicle rail portions 20, 22 are oriented parallel to each other to maintain a constant spacing between them. Identical first and second connecting rail portions 26, 28 are individually rotatably connected using a rotatable connecting joint 30 to a rear end of each of first and second inner vehicle rail portions 20, 22. First and second connecting rail portions 26, 28 are each positioned in a fully forward rotated condition when door 15 is in the fully upright and closed condition shown. A sliding connection end 32 of each of first and second connecting rail portions 26, 28 is slidably connected to each of a first and second step mounted rail portions 34, 36 each connected to step assembly 14. At least one connecting member 38 fixedly connected to each of first and second step mounted rail portions 34, 36 is used to connect and angularly orient first and second step mounted rail portions 34, 36 with respect to step assembly 14.

Figure 3:
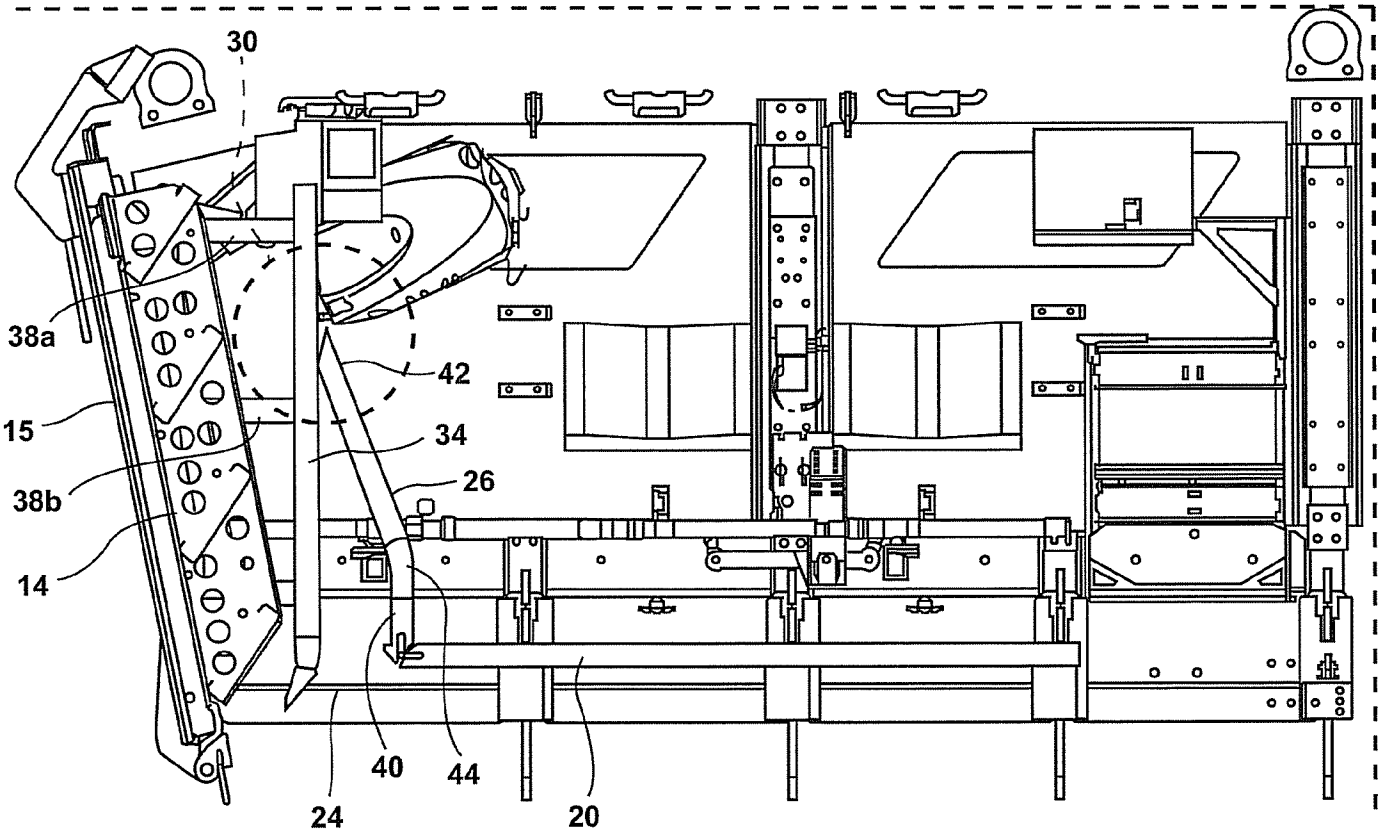
FIG. 3 is a right side elevational view of the ambulance vehicle of FIG. 1 having the right vehicle wall removed for clarity.

Referring to FIG. 3, door 15 is positioned in the fully upright and closed condition, the right side wall and components of vehicle 10 have been removed for clarity, and therefore only the components of the left hand side of cargo loading rail system 12 are shown. The right hand components of the cargo loading rail system 12 duplicate the left hand side arrangement; therefore, the following discussion of the left hand side components applies equally to the right hand side components with respect to the following discussion of FIGS. 3-7. In the fully upright and closed condition of door 15, first inner vehicle rail portion 20 is oriented substantially horizontal and parallel to vehicle floor 24. A first connecting end 40 of first connecting rail portion 26 is rotatably connected at a rear end of first inner vehicle rail portion 20 and in this condition is oriented substantially vertical. A second connecting end 42 of first connecting rail portion 26 is slidingly connected to first step mounted rail portion 34. First step mounted rail portion 34 in the stowed position is oriented substantially vertical. A bend section 44 of first connecting rail portion 26 is positioned between and integrally joins first and second connecting ends 40, 42. The sliding connection between second connecting end 42 and first step mounted rail portion 34 is positioned between first and second connecting members 38*a*, 38*b*.

Figure 4:
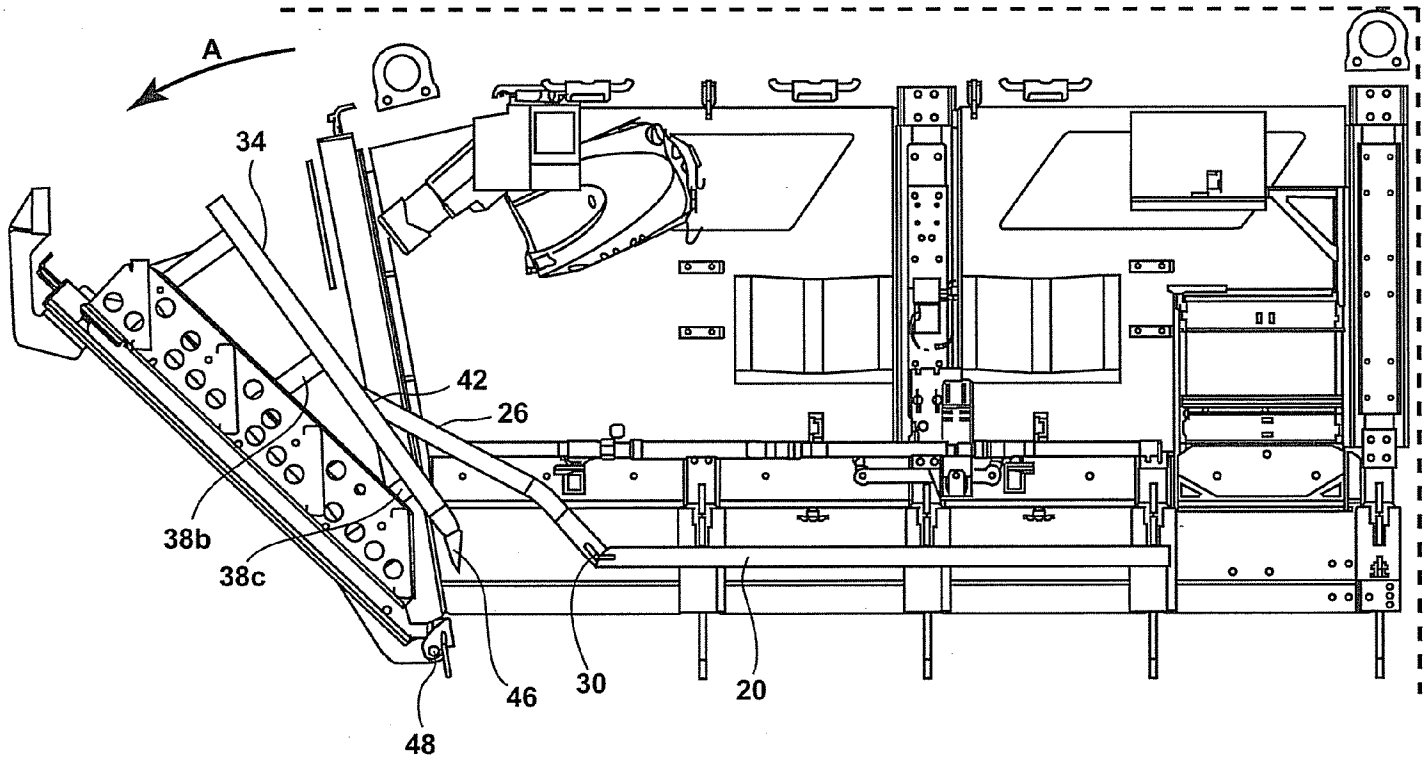
FIG. 4 is the right side elevational view of FIG. 3 showing a rear vehicle door in a partially extended condition.

Referring to FIG. 4, door 15 is shown in a partially open position. As door 15 rotates open, the sliding connection between second connecting end 42 and first step mounted rail portion 34 is slidingly repositioned between second connecting member 38*b* and a third connecting member 38*c*. First connecting rail portion 26 rotates counterclockwise using rotatable connecting joint 30 to permit continuous sliding contact between first connecting rail portion 26 and first step mounted rail portion 34. Second connecting end 42 slides toward an angular joint 46 created at a first end of first step mounted rail portion 34. Door 15 rotates about an opening arc of rotation "A" with respect to a hinge 48 rotatably connecting door 15 to vehicle 10.

Figure 5:
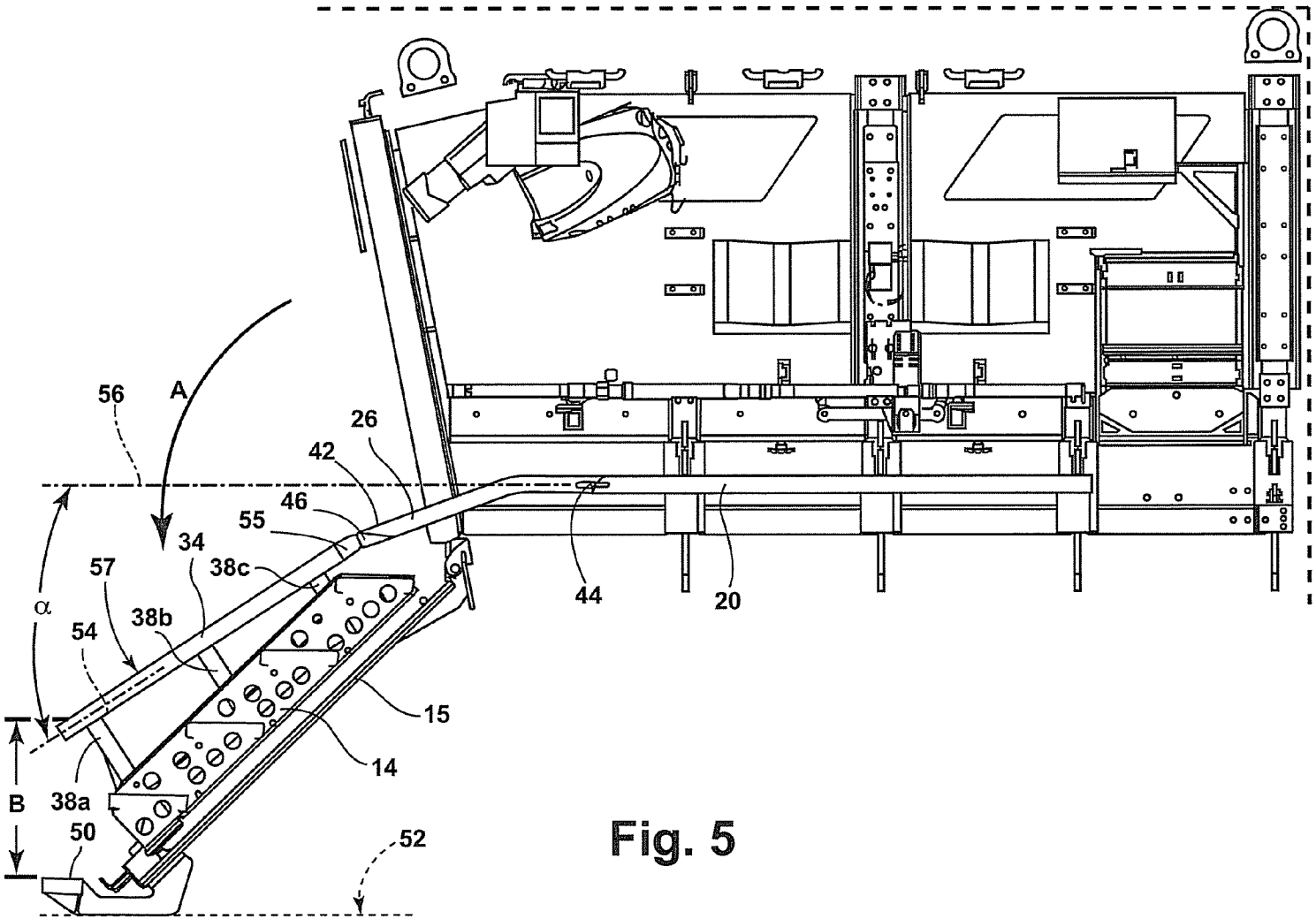
FIG. 5 is the right side elevational view of FIG. 3 showing the rear vehicle door in a completely extended condition.

Referring to FIG. 5, door 15 has completed rotation about arc of rotation "A" such that door 15 is positioned in a fully open position. In the fully open position, contact is made between angular joint 46 of first step mounted rail portion 34 and second connecting end 42 of first connecting rail portion 26. A lower step portion 50 of step assembly 14 is positioned substantially horizontal to and can be in contact with a ground surface 52. A free end 54 of first step mounted rail portion 34 is positioned at an elevation height "B" with respect to lower step portion 50 and within a predetermined height with respect to ground surface 52. A second bend section 55 can be integrally provided with first step mounted rail portion 34, if desired. Step assembly 14 and door 15 can be oriented an angle of approximately 45 degrees with respect to a longitudinal axis 56 of first inner vehicle rail portion 20. A length of each of connecting members 38*a*, 38*b*, 38*c* can be successively less to provide an angle $\alpha$ between first step mounted rail portion 34 and longitudinal axis 56. According to several embodiments, angle $\alpha$ ranges between approximately 20 to 30 degrees inclusive, providing a benefit which will be described in greater detail in the discussion of FIGS. 6-8. When door 15 is in the fully open condition, a substantially smooth, continuous rail surface 57 is created by first inner vehicle rail portion 20, first connecting rail portion 26, and first step mounted rail portion 34.

Figure 6:
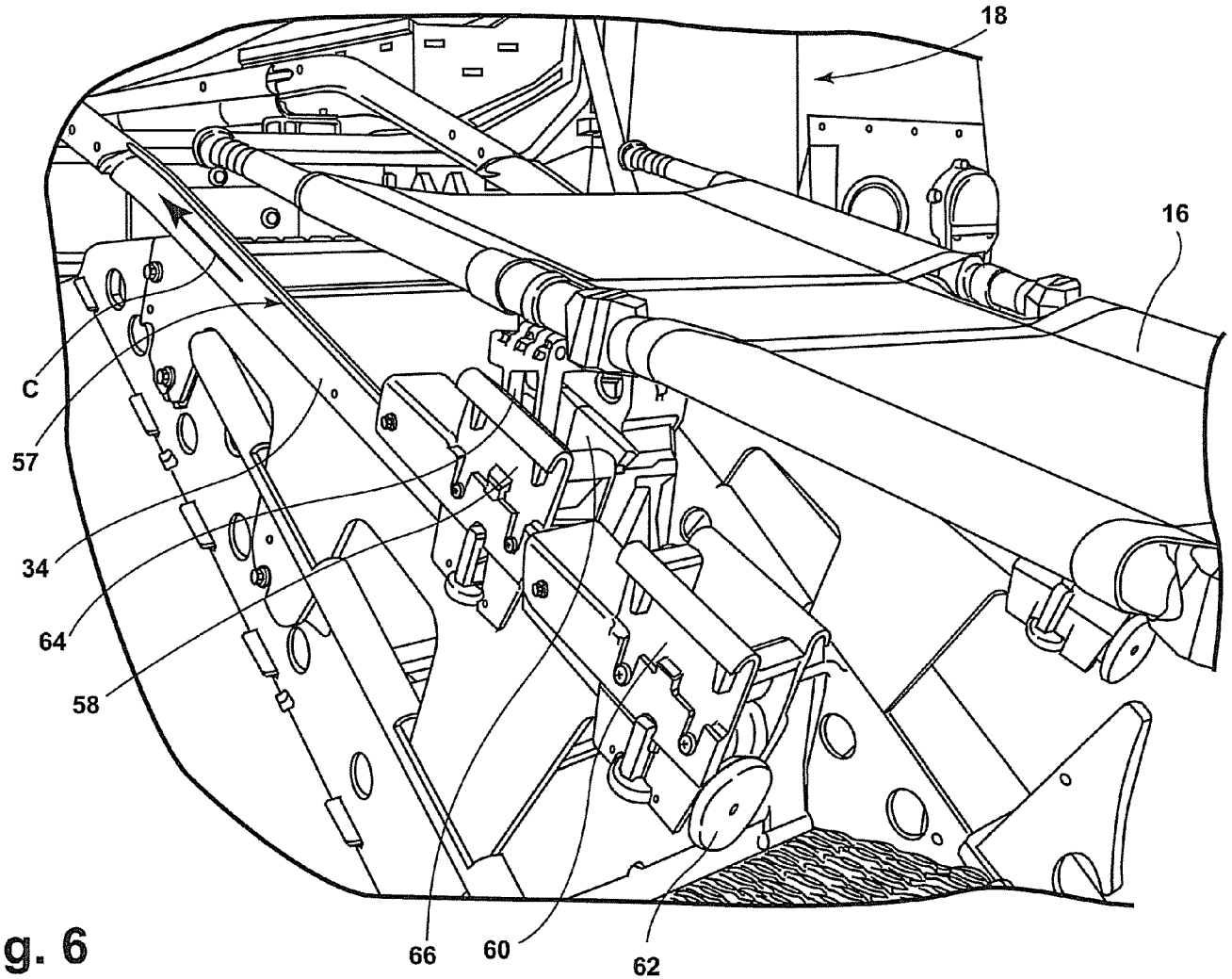
FIG. 6 is a rear left perspective view looking forward similar to FIG. 1 showing a litter in an initial engagement position.

Referring to FIG. 6, first and second trolley members 58, 60 are shown in deployed, ready to engage positions on first step mounted rail portion 34. Each of first and second trolley members 58, 60 can roll with respect to continuous rail surface 57, and are temporarily held in the deployed position by contact between second trolley member 60 and a stop member 62 fixed to free end 54 of first step mounted rail portion 34. The following discussion identifies the operation of loading litter 16 into the vehicle cargo bay 18 of vehicle 10 using cargo loading rail system 12. Litter 16 includes a first litter support post 64 which is inserted downwardly into a first trolley cavity 66 of first trolley member 58 and thereafter supported by first trolley member 58. By pushing litter 16 in a loading direction "C", the pushing force is transferred through first litter support post 64 to trolley member 58. First trolley member 58 will thereafter roll on first step mounted rail portion 34.

Referring to FIG. 7 and again to FIG. 5, by continuing to push litter 16 in the loading direction "C", first trolley member 58 rolls onto first connecting rail portion 26. Second trolley member 60 remains in contact with stop member 62 until a second litter support post 68 of litter 16 is aligned with and can be downwardly inserted into a second trolley cavity 70 of second trolley member 60. Continued displacement of litter 16 in the loading direction "C" will thereafter move second trolley member 60 away from stop member 62 and permit litter 16 to be slidably moved into vehicle cargo bay 18. First and second trolley members 58, 60 provide rolling support for litter 16 after receipt of second litter support post 68 into second trolley cavity 70. The angle $\alpha$ defined by first stop mounted rail portion 34 is selected to minimize the rolling resistance of first and second trolley members 58, 60 during the litter loading process.

Figure 8:
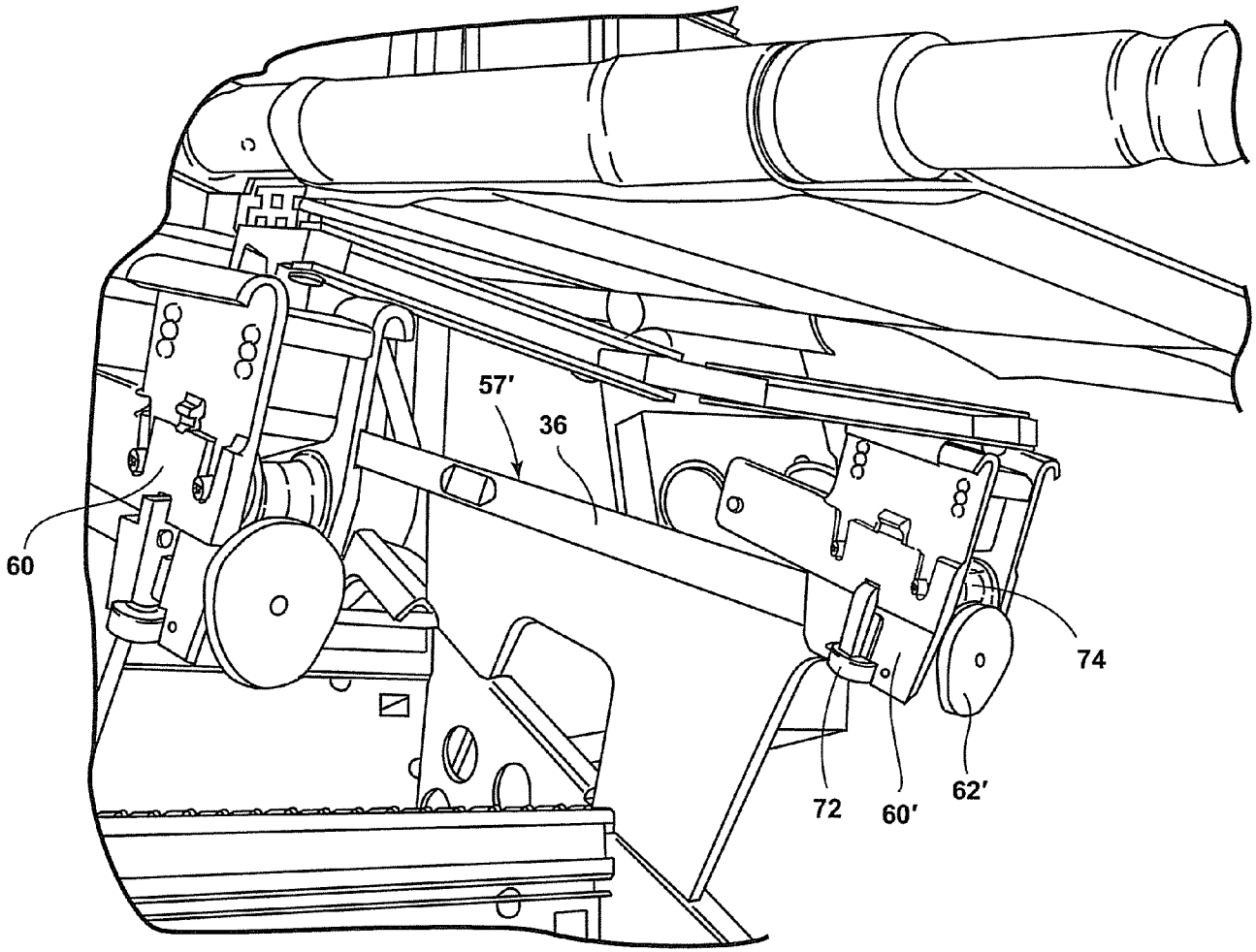
FIG. 8 is a rear left perspective view looking forward similar to FIG. 7 showing further details of the rail system.

Referring to FIG. 8, a right side second trolley member 60' is identical to second trolley member 60. All of the first and second trolley members 58, 58' (not visible in this view) and 60, 60' include a rail guide mechanism 72 that prevents the trolley members from lifting off the continuous rail surfaces 57, 57' of cargo loading rail system 12 during use. Each of the first and second trolley members 58, 58', 60, 60' also includes at least one and according to several embodiments first and second roller wheels 74, 74' (only first roller wheel 74 is visible in this view). First and second roller wheels 74, 74' can have a concave perimeter shape corresponding to the semicircular, tubular design of the rail portions of the present disclosure.

Figure 9:
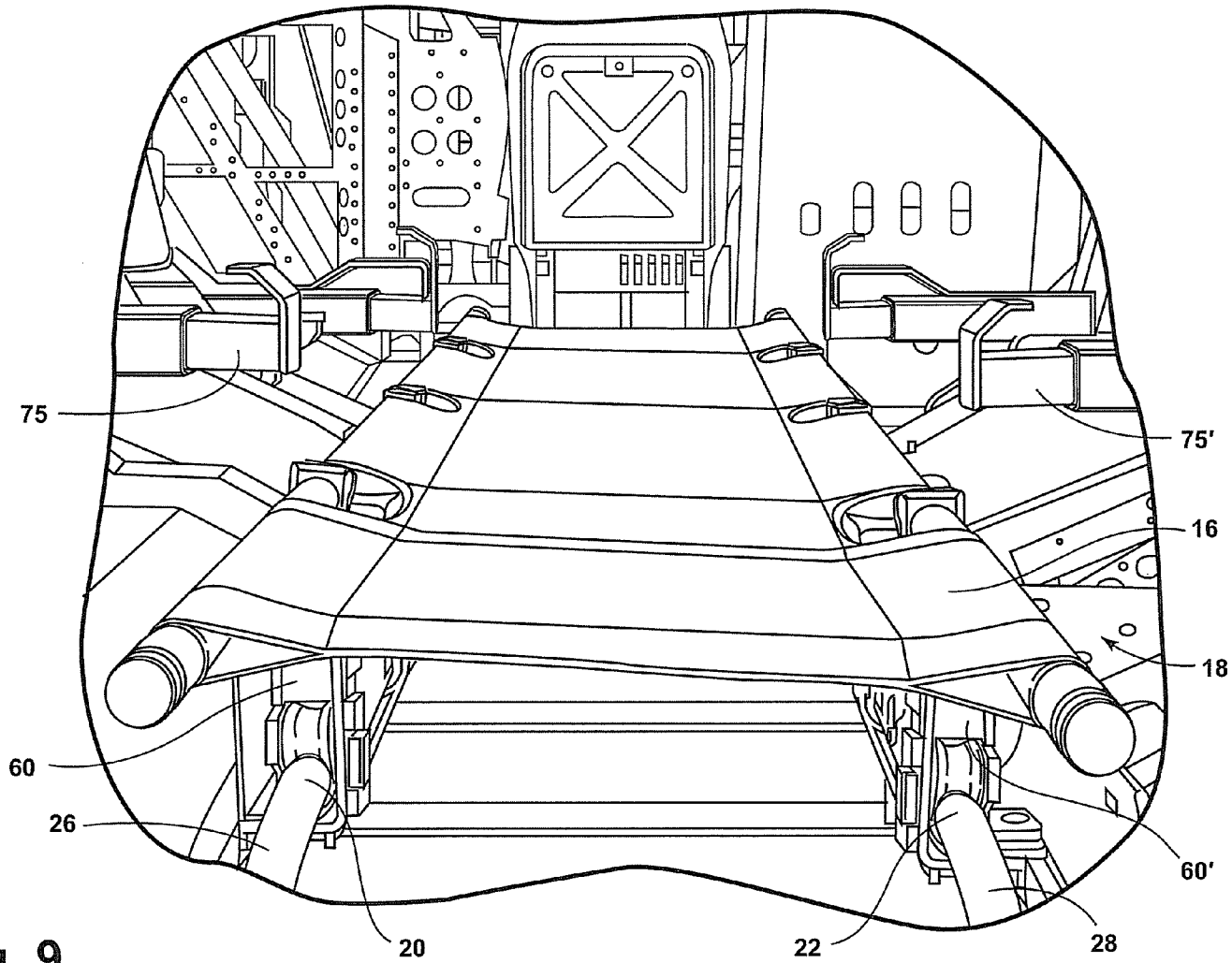
FIG. 9 is a rear elevational view looking forward of a fully loaded litter.

Referring to FIG. 9, litter 16 is shown in its loaded position in vehicle cargo bay 18. Each of the trolley members including second trolley members 60, 60' are in direct contact with and are supported by first and second inner vehicle rail portions 20, 22. Litter 16 can then be lifted off the trolley members to be temporarily supported to either a left or right hand set of support tube assemblies 75, 75' of the present disclosure.

Figure 10:
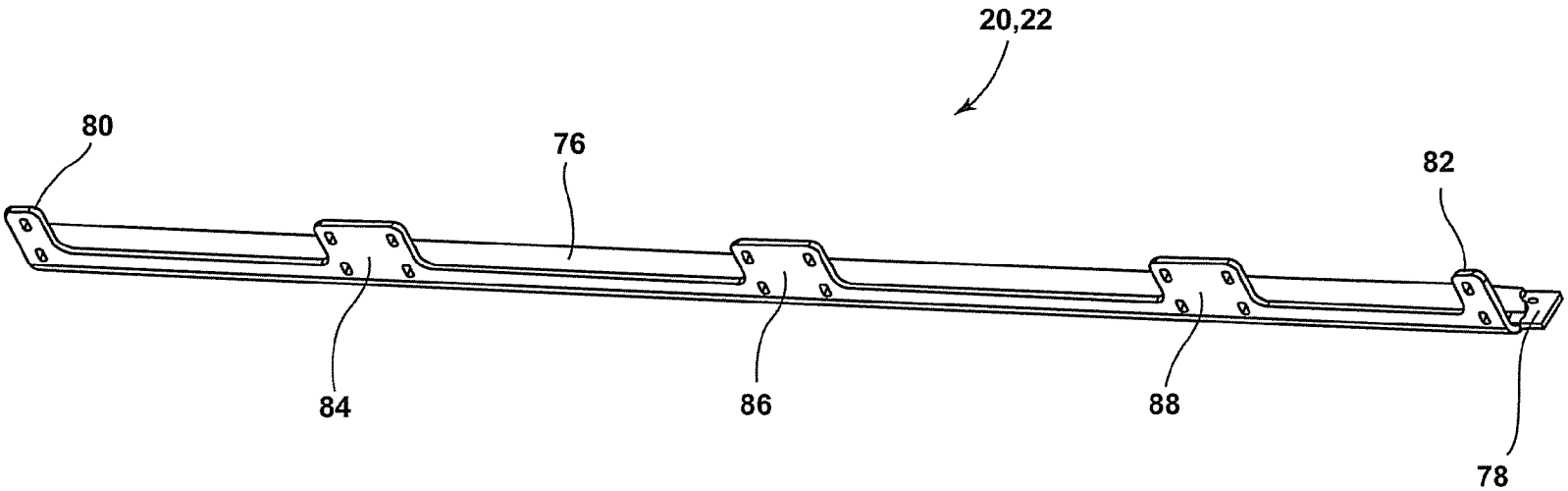
FIG. 10 is a front perspective view of an inner vehicle rail assembly.

Referring to FIG. 10 and again to FIG. 2, each of first and second inner vehicle rail portions 20, 22 are identical and include a semicircular tubular portion 76 fixed for example by welding to a continuous bracket leg 78. A plurality of bracket arms is integrally connected to bracket leg 78 and can include first and second end bracket arms 80, 82 positioned at opposite ends of bracket leg 78. First, second and third intermediate bracket arms 84, 86, 88 are equally spaced between first and second end bracket arms 80, 82. First and second end bracket arms 80, 82, as well as first, second, and third intermediate bracket arms 84, 86, 88 each have apertures to receive fasteners used to fasten first and second inner vehicle rail portions 20, 22 to vehicle floor 24.

Referring to FIG. 11 and again to FIG. 2, a length "D" of first and second inner vehicle rail portions 20, 22 can be selected to suit the length of vehicle cargo bay 18. First and second inner vehicle rail portions 20, 22 further include a free extending end 90 of bracket leg 78 which extends past second end bracket arm 82. A free extending portion 92 of semicircular tubular portion 76 can extend past first end bracket arm 80.

Figure 12:
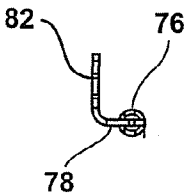
FIG. 12 is an end elevational view of the inner vehicle rail assembly of FIG. 10.

Referring to FIG. 12 and again to FIG. 8, bracket leg 78 can bifurcate semicircular tubular portion 76 so that rounded perimeter portions of semicircular tubular portion 76 are provided on both sides of bracket leg 78. This allows for continuous contact of rail guide mechanism 72 on a first side of semicircular tubular portion 76 at any position of the trolley members 58, 58', 60, 60' on cargo loading rail system 12. This also allows for continuous rolling contact of the roller wheels 74, 74' of trolley members 58, 58', 60, 60' on a second side of semicircular tubular portion 76 at any position of the trolley members 58, 58', 60, 60' on cargo loading rail system 12.

Figure 13:
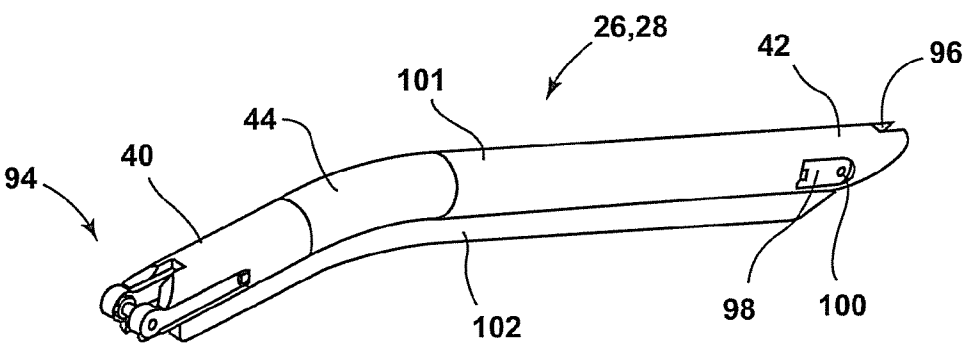
FIG. 13 is a left side perspective view of a connecting rail assembly.

Referring to FIG. 13, first and second connecting rail portions 26, 28 are identical to each other and each include a connecting mechanism 94 at first connecting end 40, a slot 96 at the opposite second connecting end 42, and a flat, fastener mounting surface 98 positioned proximate to and oriented approximately 90 degrees with respect to slot 96. A fastener receiving aperture 100 is created perpendicularly through fastener mounting surface 98. First and second connecting rail portions 26, 28 consist predominantly of a continuous semicircular tube portion 101 extending from first to second connecting ends 40, 42 with a reinforcing member 102 connected at a right angle to semicircular tube portion 101 to increase the rigidity of first and second connecting rail portions 26, 28.

Figure 14:
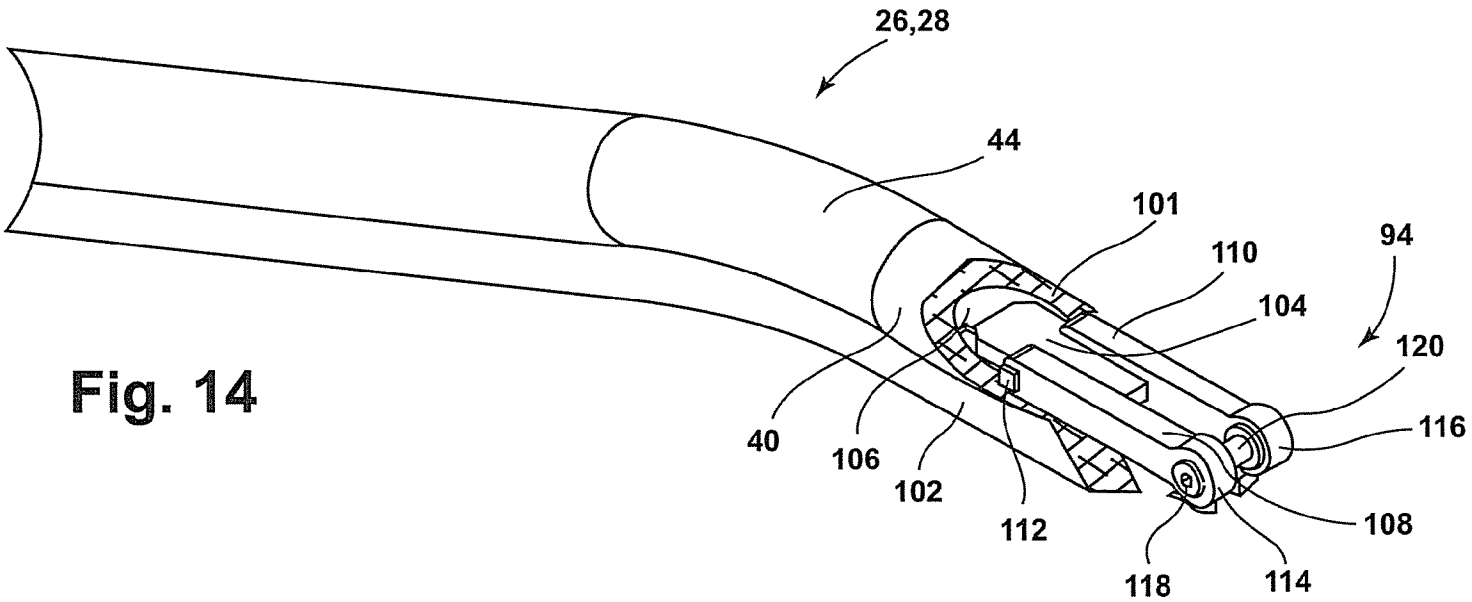
FIG. 14 is a right side perspective view of the connecting rail assembly of FIG. 13.

Referring to FIG. 14, connecting mechanism 94 includes a frictional engagement plate 104 received in an inner cavity 106 of semicircular tube portion 101 and frictionally engaging the inner wall defined by inner cavity 106. Frictional engagement plate 104 can also be welded to reinforcing member 102. First and second extending arms 108, 110 are fastened to frictional engagement plate 104 using a fastener 112. First and second rounded bearing ends 114, 116 both receive a fastener 118 such that a non-threaded shank portion 120 of fastener 118 is freely disposed between first and second bearing ends 114, 116. Non-threaded shank portion 120 provides a rotatable connection portion extending freely out of first connecting end 40.

Referring to FIG. 15 and again to FIGS. 13 and 14, opposed first and second angular end faces 122, 123 face oppositely with respect to each other and each define an acute angle with respect to a central longitudinal axis 124 of first and second connecting rail portions 26, 28. A second connecting mechanism 125 is positioned proximate first angular end face 122. A second frictional engagement plate 126 is connected and functions similar to frictional engagement plate 104. Opposed, identical first and second side plates 128, 128' (only first side plate 128 is visible in this view) are each non-rotatably received in one of the fastener mounting surfaces 98, 98' and are joined by a fastener 130. As clearly evident in FIG. 15, reinforcing member 102 includes a radius "E" matching the curved geometry of bend section 44.

Figure 16:
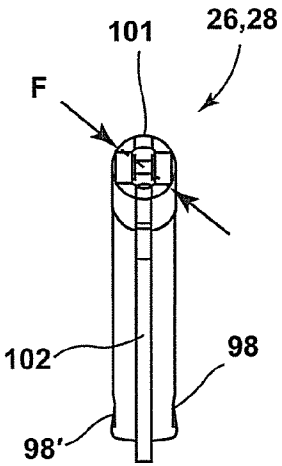
FIG. 16 is an end elevational view of the connecting rail assembly of FIG. 13.

Referring to FIG. 16, semicircular tube portion 101 has a diameter "F". Opposed first and second fastener mounting surfaces 98, 98' are oppositely directed with respect to each other and are each rotated approximately 90 degrees from reinforcing member 102.

Figure 17:
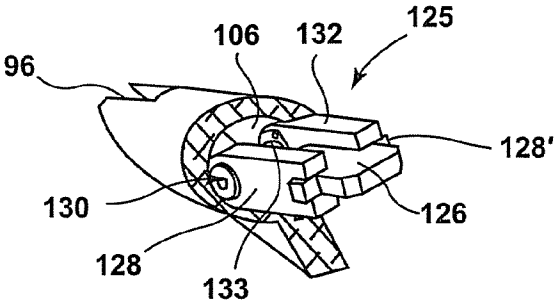
FIG. 17 is a cross sectional perspective view taken at section 17 of FIG. 15.

Referring to FIG. 17, outwardly extending ears of second frictional engagement plate 126 lock into correspondingly shaped slots of first and second side plates 128, 128' to prevent rotation of first and second side plates 128, 128'. A rocker arm 132 is rotatably connected to a non-threaded shank portion 133 of fastener 130 between first and second side plates 128, 128'.

Figure 18:
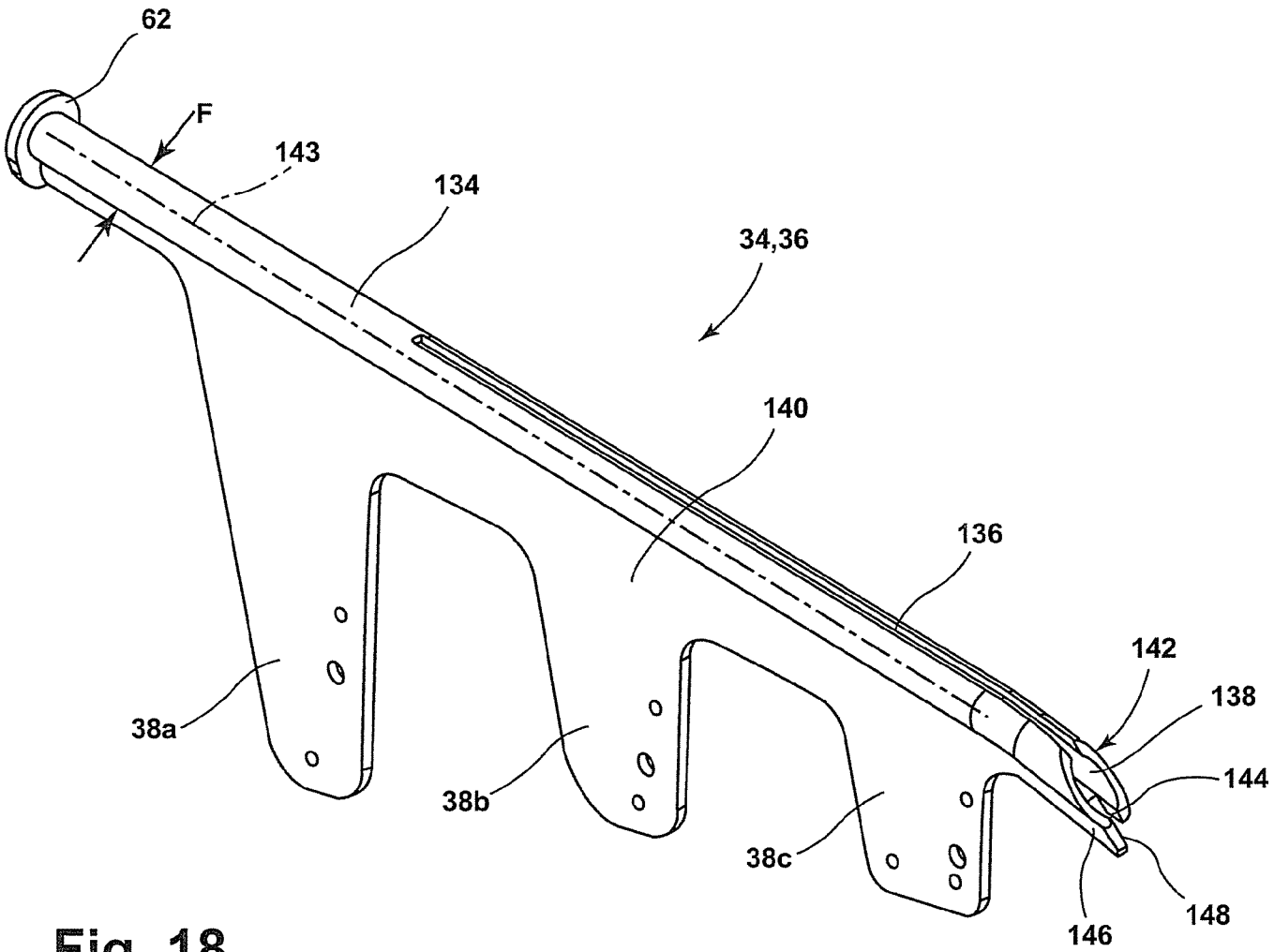
FIG. 18 is a front perspective view of a step mounted rail assembly.

Referring to FIG. 18, first and second step mounted rail portions 34, 36 are identical and each include a semicircular tube portion 134 having a diameter "F" with stop member 62 fixed, such as by welding to one end. A longitudinal closed end slot 136 created in an upward facing side of semicircular tube portion 134 opens into an open end 138 of semicircular tube portion 134 and extends for at least 50% of a length of semicircular tube portion 134. A plate 140 is fixed to and extends perpendicular to semicircular tube portion 134. Plate 140 includes connecting members 38*a*, 38*b*, 38*c*. An angular end face 142 is created at the free end of semicircular tube portion 134 which is oriented at an acute angle with respect to a longitudinal axis 143 of semicircular tube portion 134. A slot 144 of semicircular tube portion 134 receives a portion of plate 140 for welding. An extending portion 146 of plate 140 includes an angular end face 148 which is oriented at an acute angle equal to the acute angle of angular end face 142.

Figure 7:
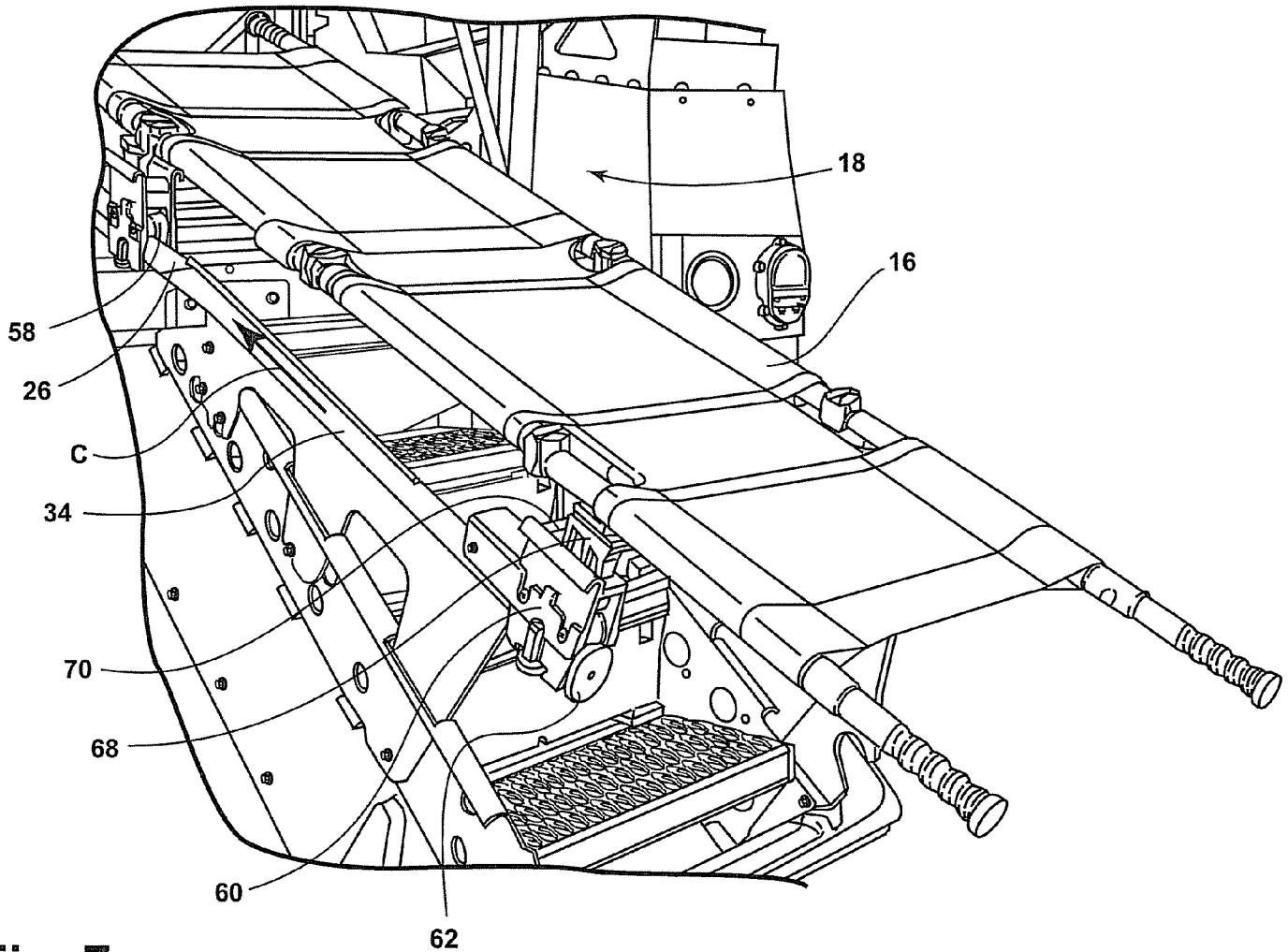
FIG. 7 is a rear left perspective view looking forward similar to FIG. 6 showing the litter in a complete engagement position.
Figure 19:
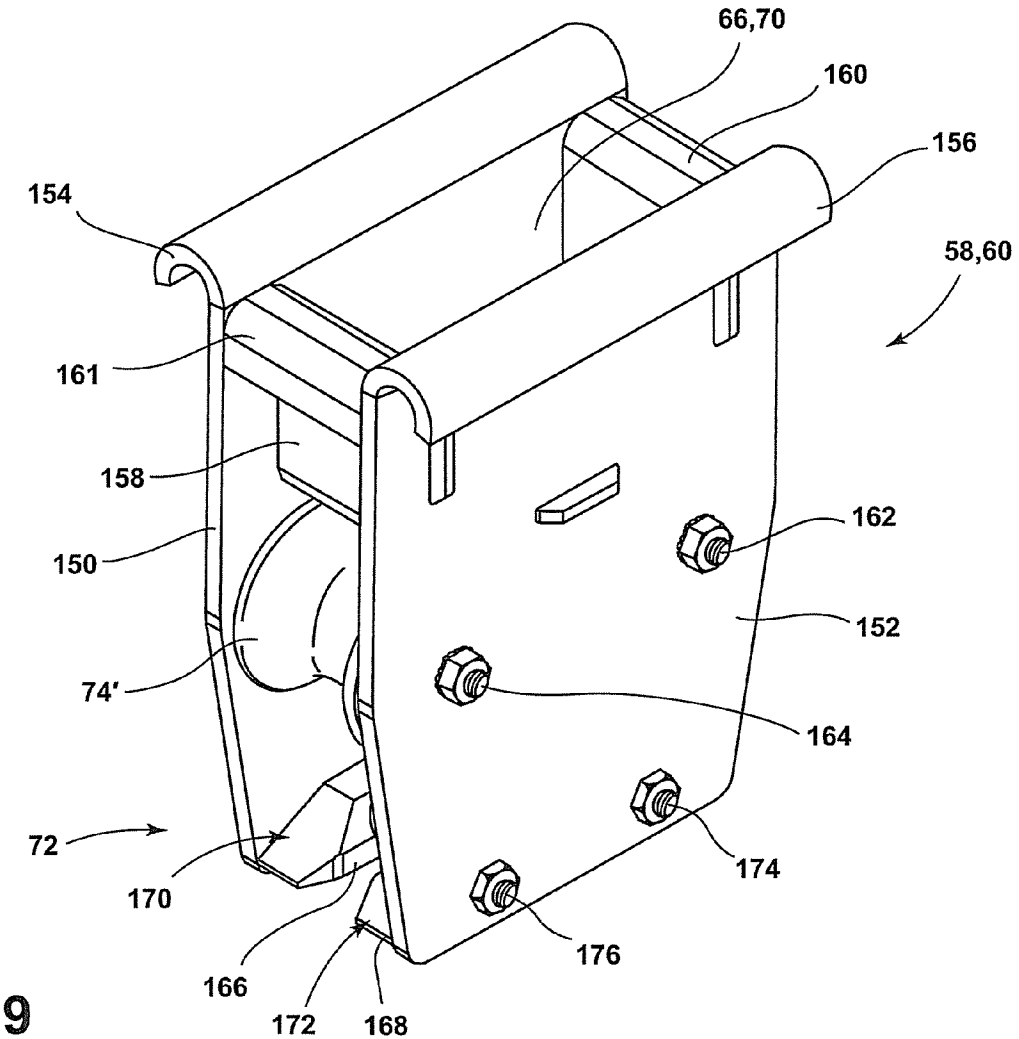
FIG. 19 is a front left perspective view of a trolley of the present disclosure.

Referring to FIG. 19 and again to FIGS. 6 and 7, the trolley members 58, 58', 60, 60' are identical and each include mirror image first and second side plates 150, 152 having a first rolled edge 154 and a second rolled edge 156. A cup-shaped member 158 is received between first and second side plates 150, 152 which includes third and fourth rolled edges 160, 161 which are oppositely directed with respect to first and second rolled edges 154, 156. Together, first, second, third, and fourth rolled edges 154, 156, 160, 161 define the entrance of first and second trolley cavities 66, 70. The roller wheels 74, 74' (only roller wheel 74' is visible in this view) are individually mounted using first and second fasteners 162, 164 extending through both first and second side plates 150, 152. Rail guide mechanism 72 includes first and second guide members 166, 168 individually fastened to one of first or second side plates 150, 152. First guide member 166 includes a chamfered face 170 and second guide member 168 includes a chamfered face 172 which together assist alignment of the trolley members as the trolley members traverse bends and joints of the semicircular tube portions of the rail portions 20, 22, 26, 28, 34, 36. Fasteners 174, 176 individually couple first and second guide members 166, 168 to first or second side plates 150, 152.

Figure 20:
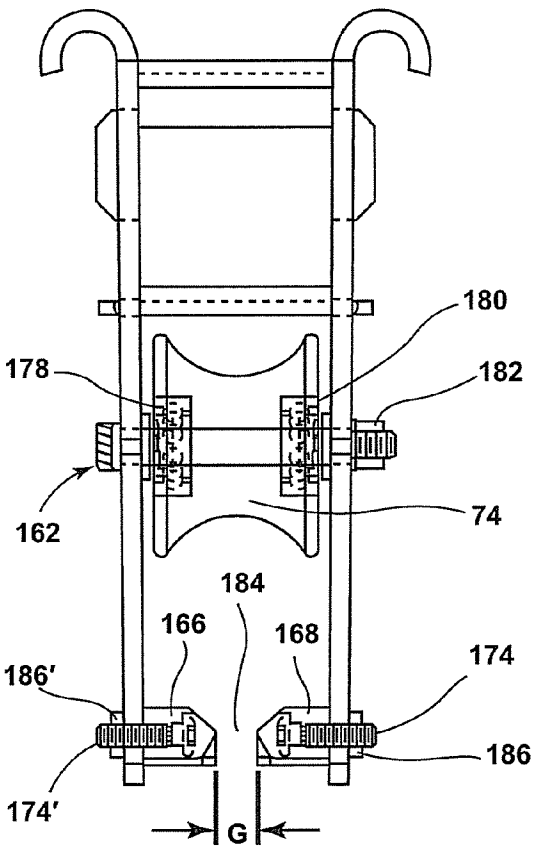
FIG. 20 is an end elevational view of the trolley of FIG. 19.

Referring to FIG. 20 and again to FIGS. 16 and 18, the roller wheels 74, 74' are both connected using first and second bearing assemblies 178, 180 and first and second nuts 182, 182' are connected to the first and second fasteners 162, 164 to retain roller wheels 74, 74'. A gap 184 having a gap width "G" is provided between first and second guide members 166, 168. Gap width "G" provides for a sliding fit with respect to both reinforcing member 102 and plate 140 as first and second trolley members 58, 58', 60, 60' traverse the cargo loading rail system 12. Nuts 186, 186' are connected to each of fasteners 174, 174', 176, 176' to releasably fix first and second guide members 166, 168.

Figure 21:
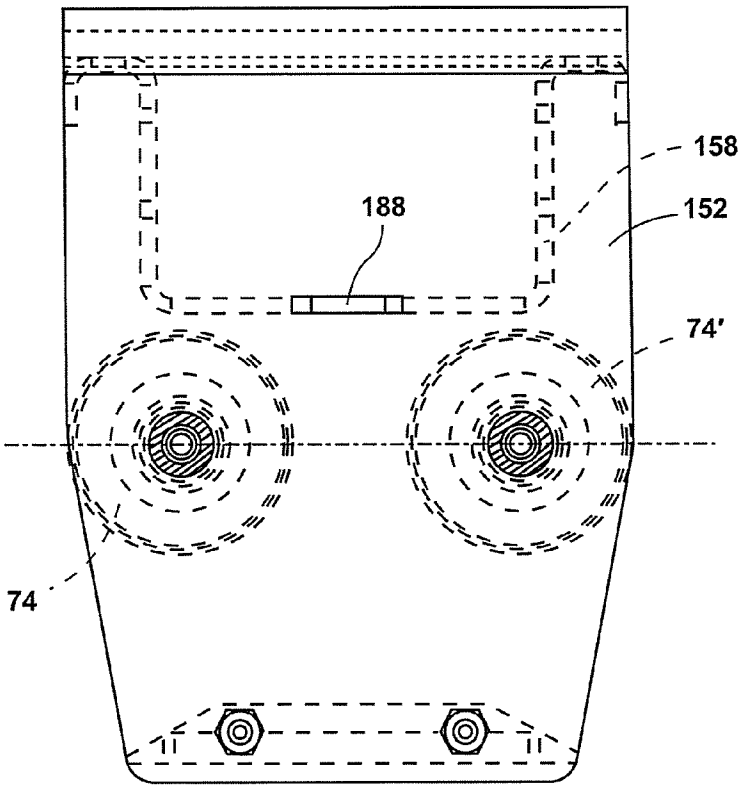
FIG. 21 is a front elevational view of the trolley of FIG. 19.

Referring to FIG. 21, at least one and according to several embodiments a plurality of extending keys 188 are provided with cup-shaped member 158 and are slidably received in appropriately shaped slots in first and second side plates 150, 152 to prevent displacement or rotation of cup-shaped member 158 with respect to first and second side plates 150, 152. The roller wheels 74, 74' are both axially positioned on a common horizontal axis 189.

Figure 22:
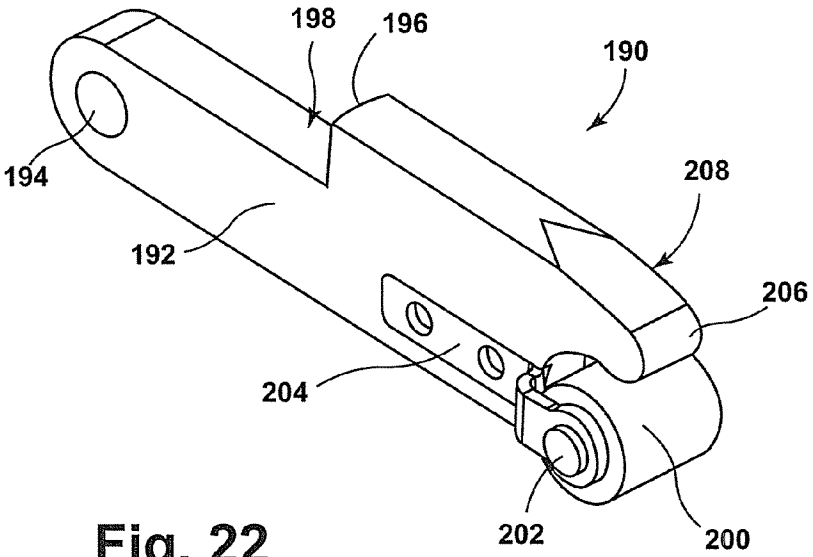
FIG. 22 is a top right perspective view of a rail slide connector of the present disclosure.

Referring to FIG. 22 and again to FIG. 17, a roller fitting assembly 190 includes a bar-shaped body 192 having an aperture 194 proximate one end thereof. Aperture 194 is sized to be rotatably engaged on non-threaded shank portion 133 of fastener 130, rotatably connecting roller fitting assembly 190 to second connecting mechanism 125 of first and second connecting rail portions 26, 28. A shoulder 196 is received in slot 96 and a rotation stop of roller fitting assembly 190 is provided by a surface 198. A roller member 200 is rotatably connected using a pin 202 to first and second flanges 204, 206 (second flange 206 is not clearly visible in this view) fastened to body 192. A bulbous nose 206 and a tapering surface 208 extend to one side of roller member 200.

Figure 23:
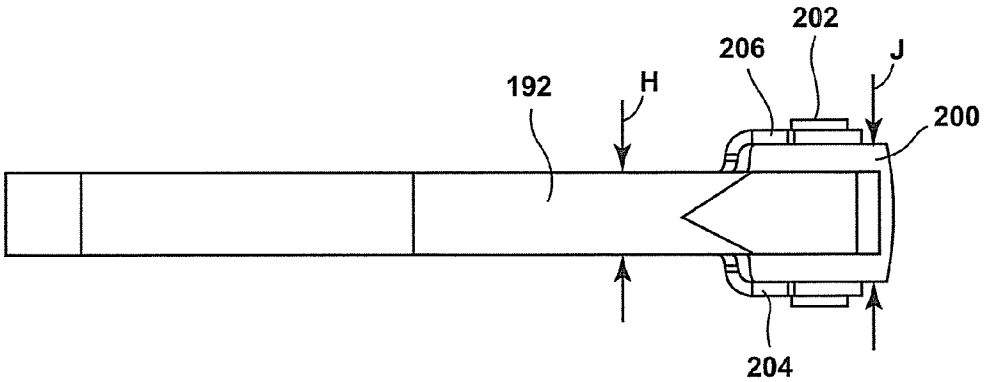
FIG. 23 is a top plan view of the rail slide connector of FIG. 22.

Referring to FIG. 23 and again to FIGS. 4-5, and 17-18, first and second flanges 204, 206 extend to outer ends of roller member 200 such that a width "H" of body 192 is less than a width "J" of roller member 200. To use roller fitting 190, roller fitting 190 is rotatably connected to non-threaded shank portion 133 of fastener 130 and roller member 200 is positioned within open cavity end 138 of semicircular tube portion 134 until body 192 is slidably received in closed end slot 136. This slidably connects first or second connecting rail portion 26 or 28 to first or second step mounted rail portion 34, 36.

Figure 24:
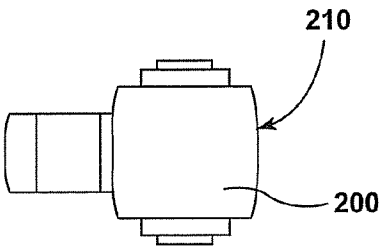
FIG. 24 is an end elevational view of the rail slide connector of FIG. 22.

Referring to FIG. 24 and again to FIGS. 4-5 and 17-18, roller member 200 can have a convex outer surface 210 to provide for self-alignment of roller member 200 as roller member moves within the inner cavity of semicircular tube portion 134 as door 15 rotates between the fully upright and fully open positions.

Figure 11:
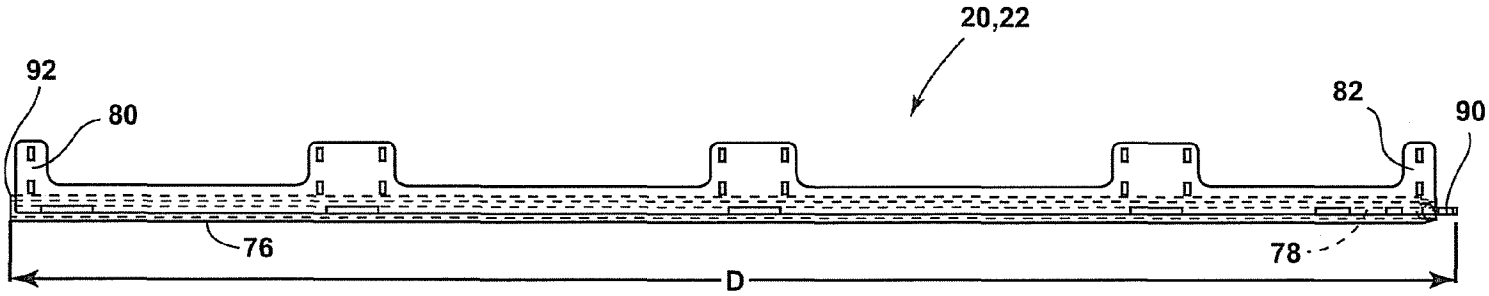
FIG. 11 is a bottom plan view of the inner vehicle rail assembly of FIG. 10.
Figure 25:
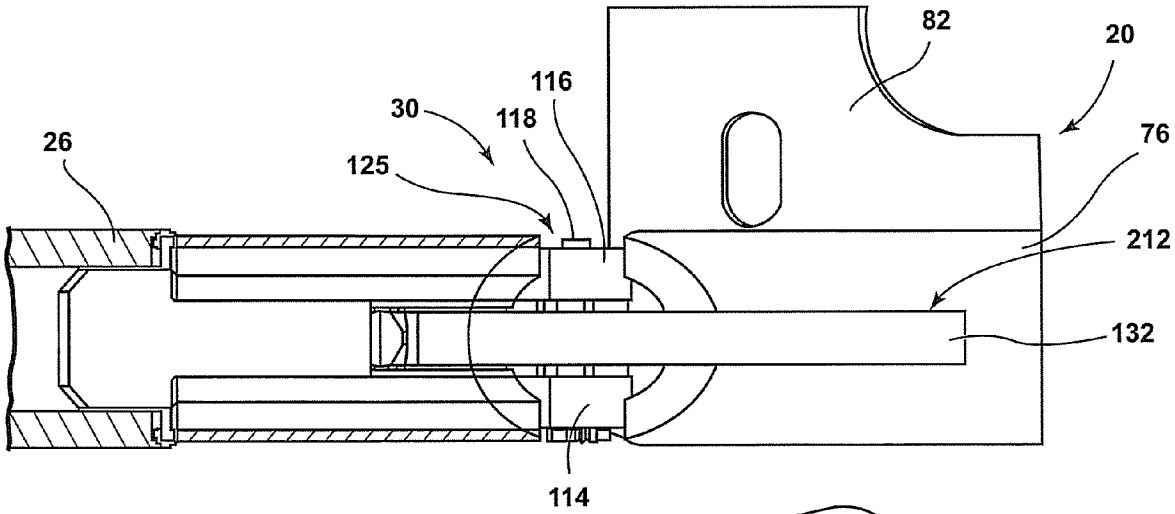
FIG. 25 is a top plan view of a rail system rotational joint assembly of the present disclosure.

Referring to FIG. 25 and again to FIGS. 11 and 14, an exemplary one of the rotatable connecting joints 30 is depicted rotatably joining first inner vehicle rail portion 20 to first connecting rail portion 26. The second frictional engagement plate 126 of second connecting mechanism 125 is slidably and frictionally received in an inner cavity of semicircular tubular portion 76. The rocker arm 132 is slidably received in a slot 212 created in semicircular tubular portion 76. Fastener 118 is slidably inserted through first bearing end 114, through an aperture of rocker arm 132, and through second bearing end 116 to rotatably connect first inner vehicle rail portion 20 to first connecting rail portion 26.

Figure 26:
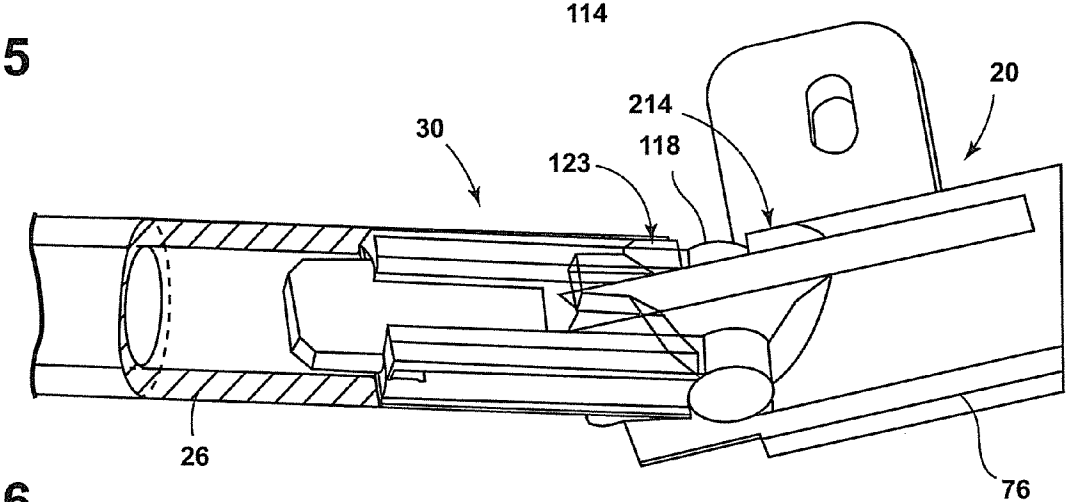
FIG. 26 is a top perspective view of the rotational joint assembly of FIG. 25.

Referring to FIG. 26, rotatable connecting joint 30 can be rotated until second angular end face 123 contacts an angular end face 214 of semicircular tubular portion 76.

Figure 27:
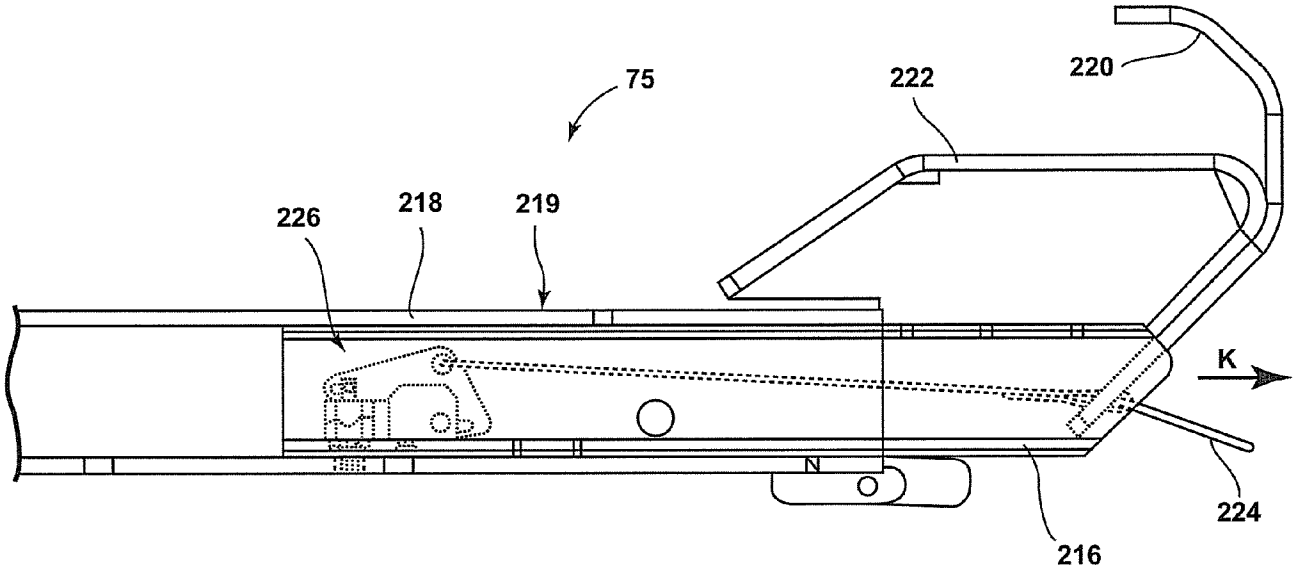
FIG. 27 is a front elevational view of a support tube assembly of the present disclosure.

Referring to FIG. 27 and again to FIG. 9, support tube assemblies 75 of the present disclosure include a first rectangular shaped tube 216 which is slidable into and out of a larger second rectangular shaped tube 218 to provide a support surface 219 for litters 16. A retainer member 220 extends from a free end of first tube 216 to help retain litters 16 from horizontal displacement. A second retainer member 222 provides for forward and rearward retention of litters 16. First tube 216 is released from one of several retention positions with respect to second tube 218 by manually pulling a release ring 224 in a release direction "K" which activates a release mechanism 226 retained within first tube 216.

Figure 28:
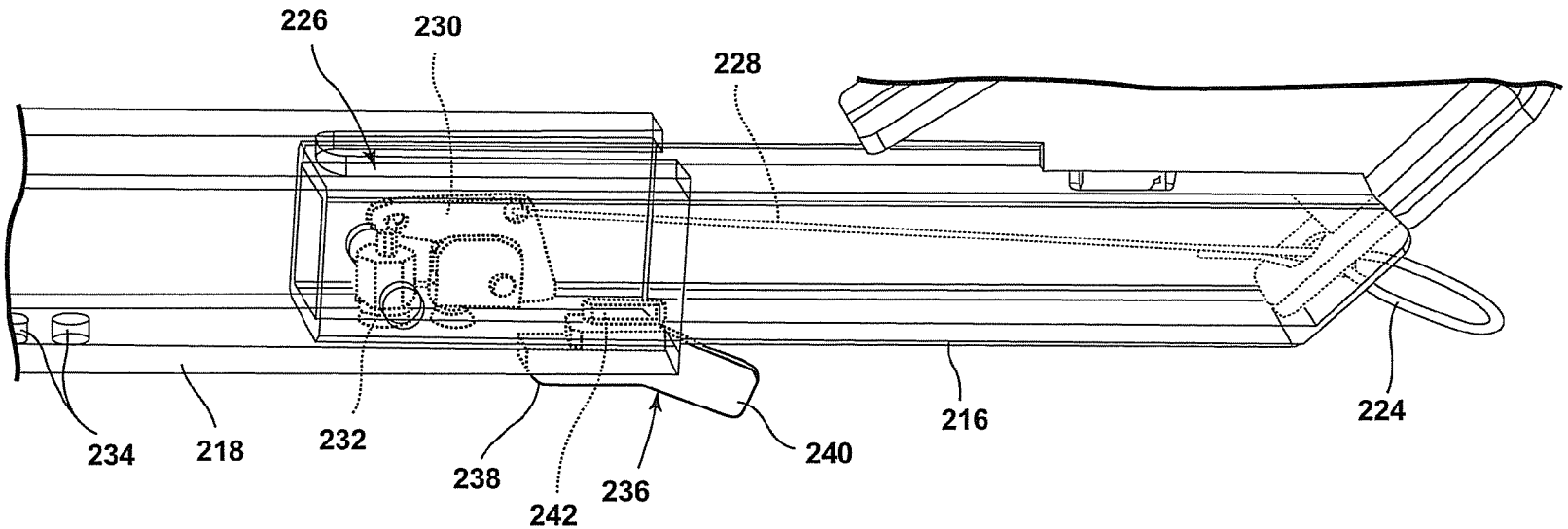
FIG. 28 is a top perspective view of the support tube assembly of FIG. 27.

Referring to FIG. 28, a flexible wire 228 is connected between release ring 224 and a rotating arm 230 of release mechanism 226. As rotating arm 230 rotates, a pin 232 is either released or engaged with respect to one or more apertures 234 created in second tube 218 to release or retain first and second tubes 216, 218. A second rocker device 236 has a first arm 238 connected to second tube 218 and a second arm 240 rotatably connected to first arm 238. A guide member 242 in first tube 216 is contacted by rotation of second arm 240 to assist in releasing first tube 216 from second tube 218.

Figure 29:
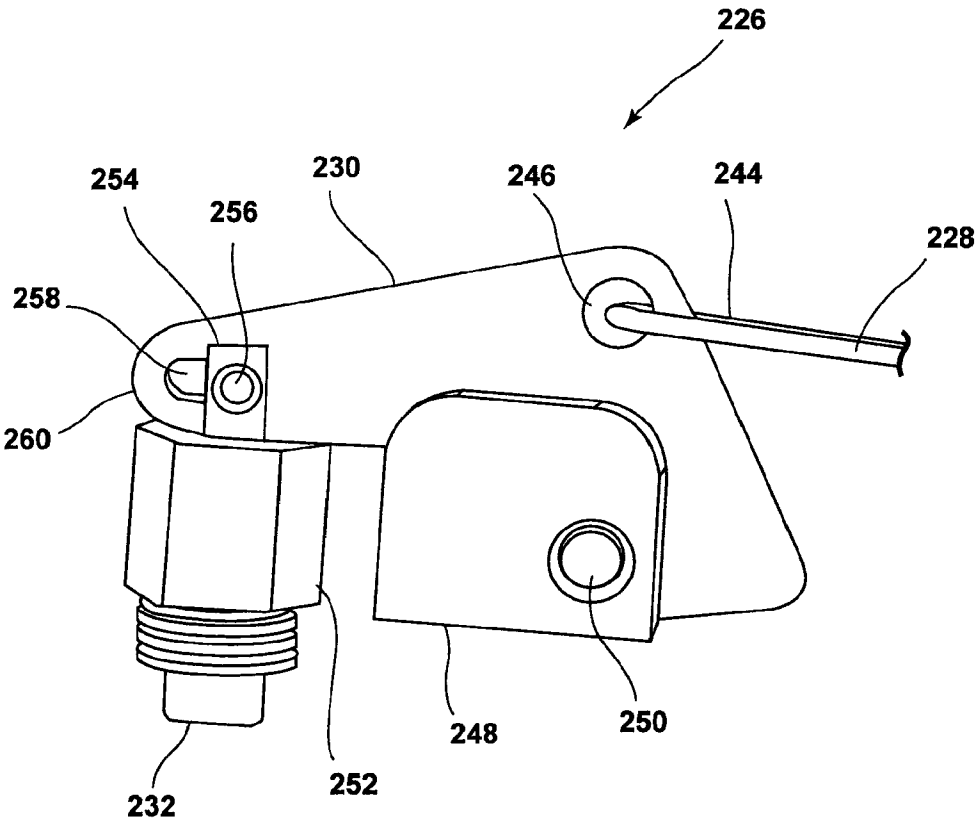
FIG. 29 is a front elevational view of a release mechanism for the support tube assembly of FIG. 27.

Referring to FIG. 29 and again to FIG. 28, further details of release mechanism 226 include a looped end 244 of flexible wire 228 captured in an aperture 246 created in rotating arm 230. Rotating arm 230 is rotatably connected to a U-shaped bracket 248 using a rotational fastener 250. Pin 232 is slidably retained in a pin housing 252. A connecting end 254 of pin 232 is pinned using a pin 256 received in a slot 258 created in an elongated end 260 of rotating arm 230. Bracket 248 is fixed such as by fastening to an inner wall of first tube 216.

Figure 15:
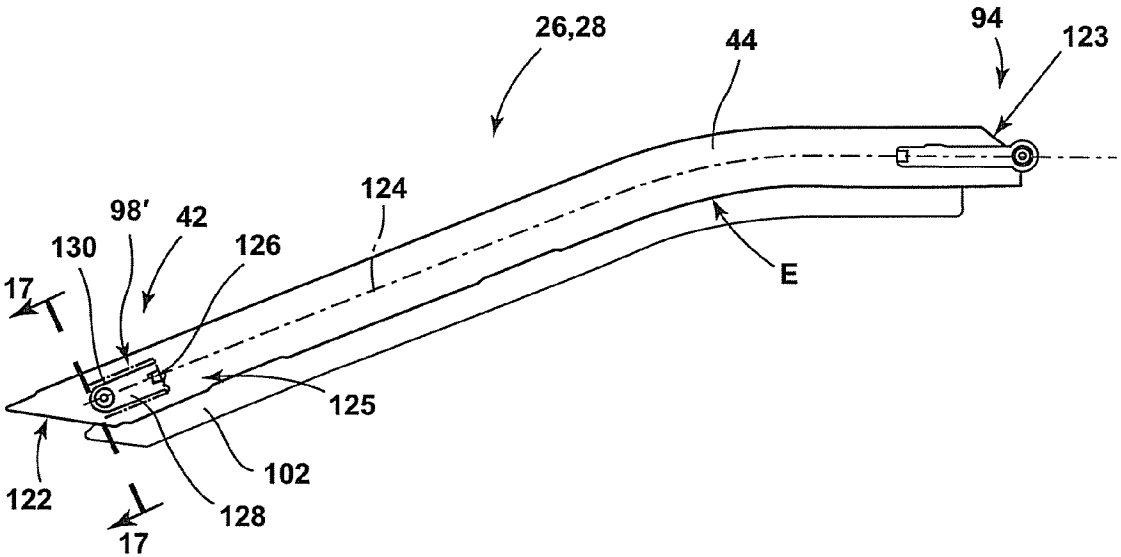
FIG. 15 is a front elevational view of the connecting rail assembly of FIG. 13.
Figure 30:
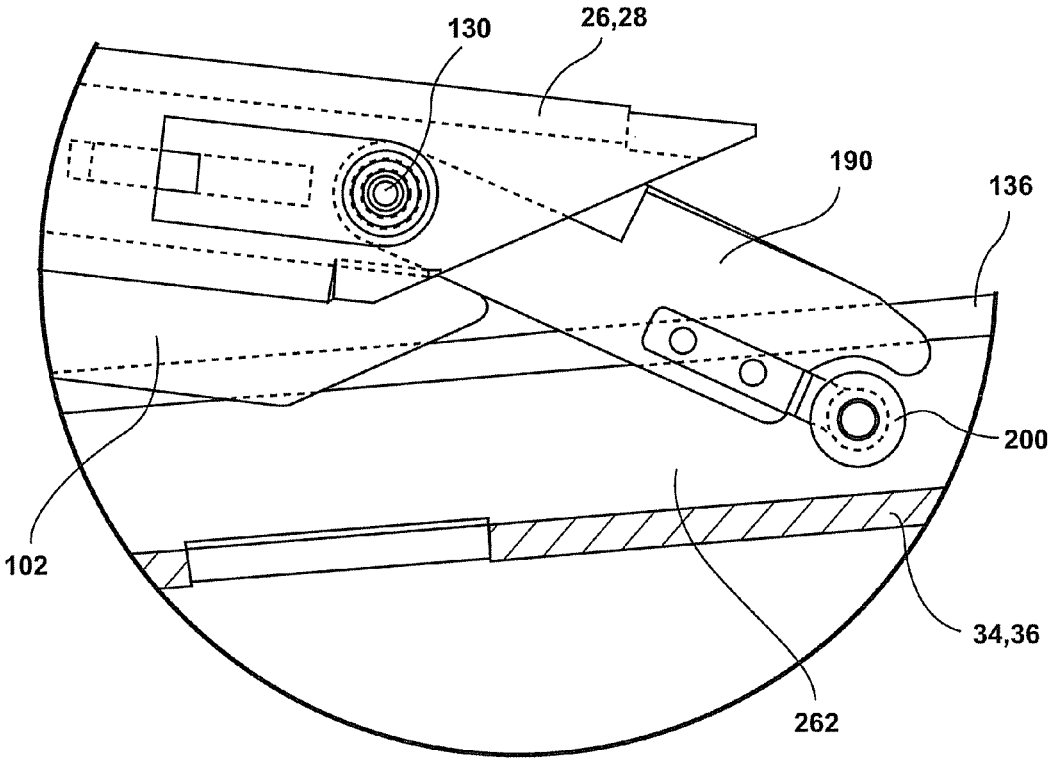
FIG. 30 is a front elevational view taken at area 30 of FIG. 3.

Referring to FIG. 30 and again to FIGS. 15 and 18, roller fitting 190 is rotatably connected using fastener 130 to first or second connecting rail portion 26 or 28. Roller member 200 is slidably received in a tubular inner passage 262 of first or second step mounted rail portion 34, 36. Reinforcing member 102 is partially slidably received in the longitudinal closed end slot 136.

Figure 31:
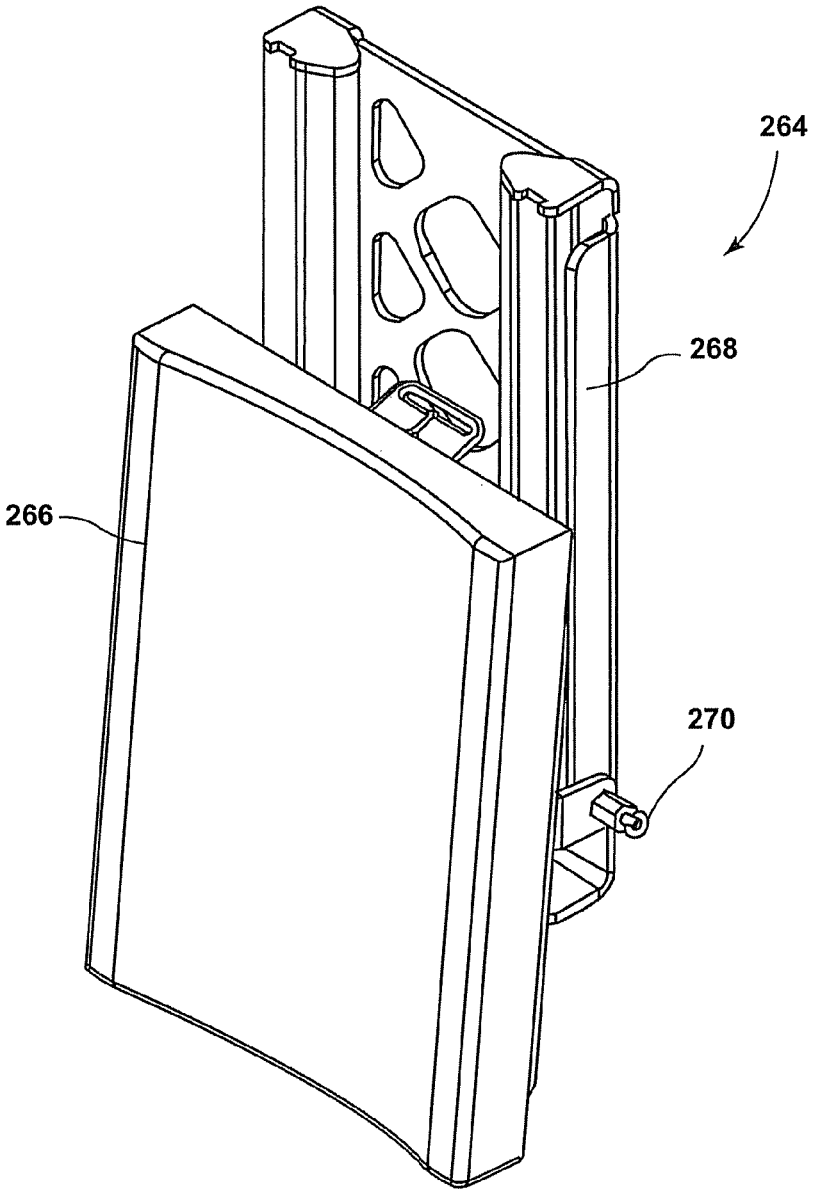
FIG. 31 is a front left perspective view of a seatback assembly of the present disclosure.

Referring to FIG. 31 and again to FIG. 1, a displaceable seatback assembly 264 can be mounted in the vehicle cargo bay of vehicle 10. Seatback assembly 264 includes a seatback pad 266 which is slidably mounted to a seatback frame 268. A catch/release device 270 is provided to permit seatback pad 266 to be moved between different locations and temporarily held in any of the positions.

Figure 32:
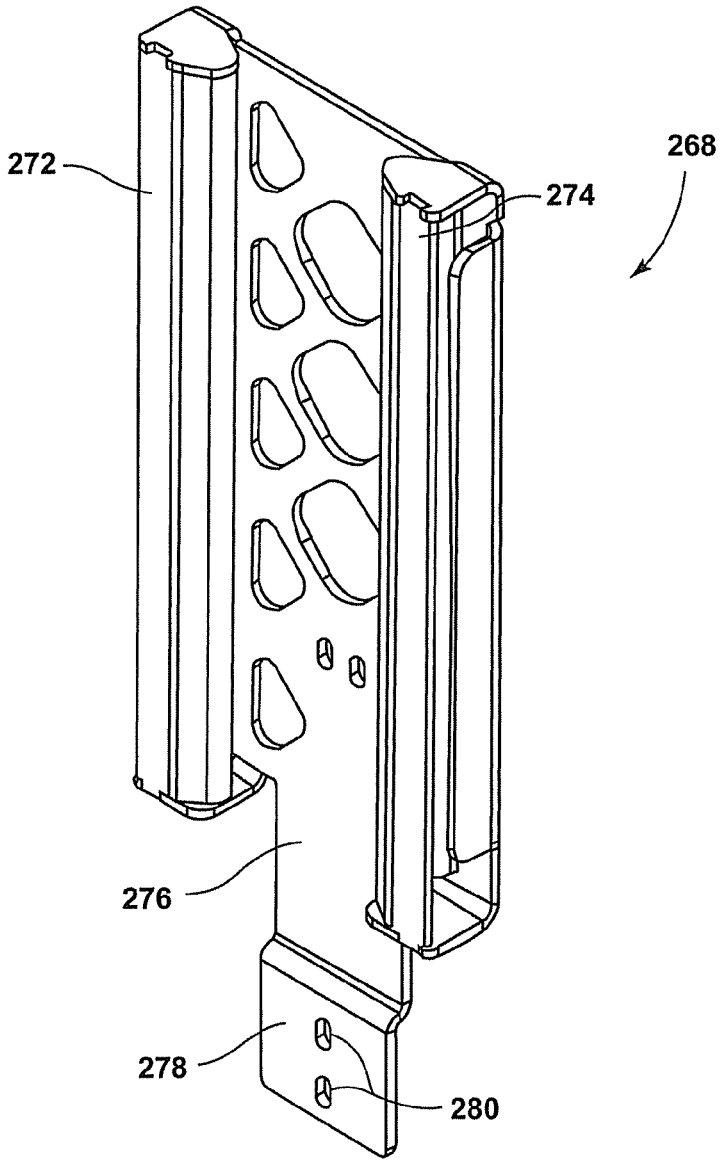
FIG. 32 is a front left perspective view of a seatback frame of the seatback assembly of FIG. 31.
Figure 36:
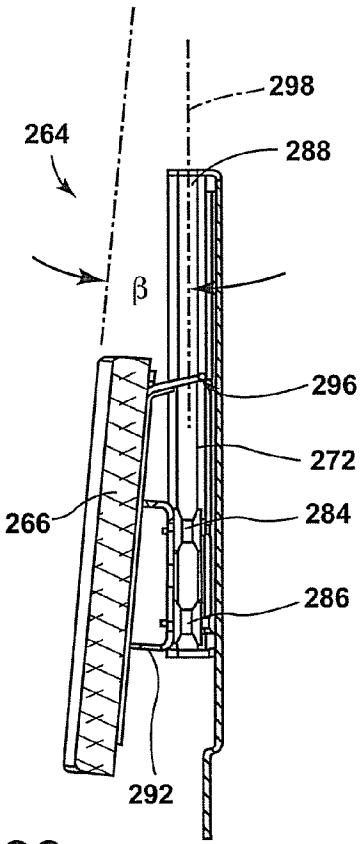
FIG. 36 is a cross sectional end elevational view at section 36 of FIG. 33.
Figure 34:
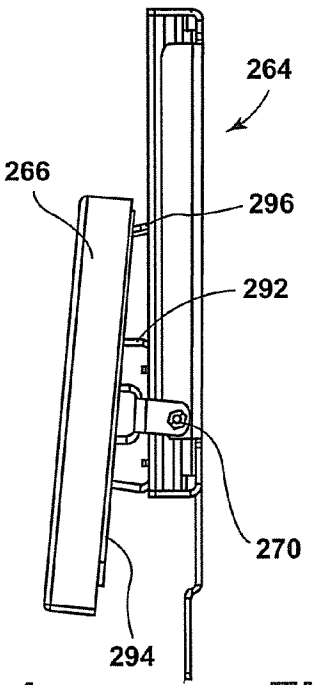
FIG. 34 is an end elevational view of the seatback assembly of FIG. 31.

Referring to FIG. 32, seatback frame 268 includes first and second side frame members 272, 274 welded or otherwise fixedly connected to a central support plate 276. A flange 278 extends downwardly from and is integrally connected to central support plate 276. Apertures 280 created in flange 278 permit mounting of seatback frame using fasteners (not shown) to structure (not shown) of vehicle 10.

Referring to FIGS. 33-36, seatback assembly 264 includes a roller wheel assembly 282 which includes first and second upper roller wheels 284, 284' and third and fourth lower roller wheels 286, 286' (fourth lower roller wheel 286' is not clearly visible in these views). Roller wheels 284, 286 contact an inner face 288 of first side frame member 272. Roller wheels 284', 286' contact an inner face 290 of second side frame member 274. First and second upper roller wheels 284, 284' and third and fourth lower roller wheels 286, 286' are each rotatably mounted to a roller wheel frame 292 which is connected to a seatback plate 294 of seatback pad 266. An upper frame member 296 which is also connected to seatback plate 294 and is positioned between first and second side frame members 272, 274 provides additional guidance for sliding motion of the roller wheel frame 292. With specific reference to FIG. 36, seatback pad 266 and seatback plate 294 can be oriented at an angle β with respect to a longitudinal axis 298 of first and second side frame members 272, 274.

Figure 35:
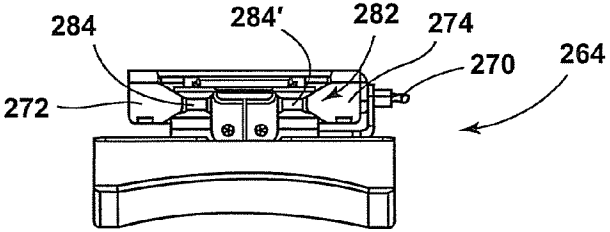
FIG. 35 is a top plan view of the seatback assembly of FIG. 31.
Figure 33:
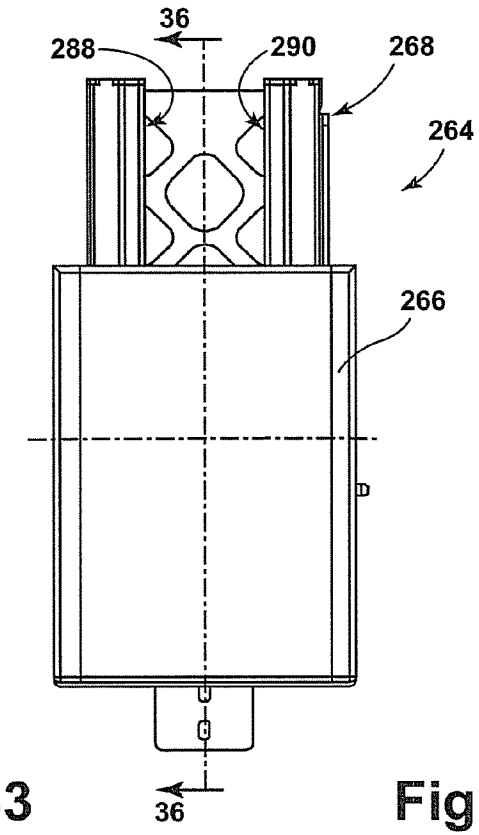
FIG. 33 is a front elevational view of the seatback assembly of FIG. 31.
Figure 37:
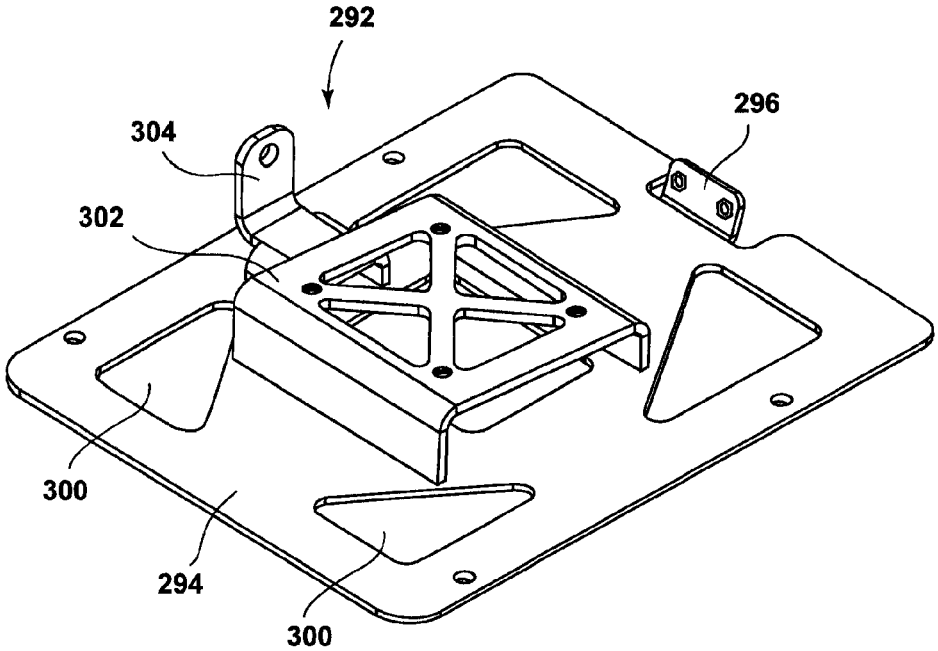
FIG. 37 is a top perspective view of a roller wheel frame for the seatback assembly of FIG. 31.
Figure 38:
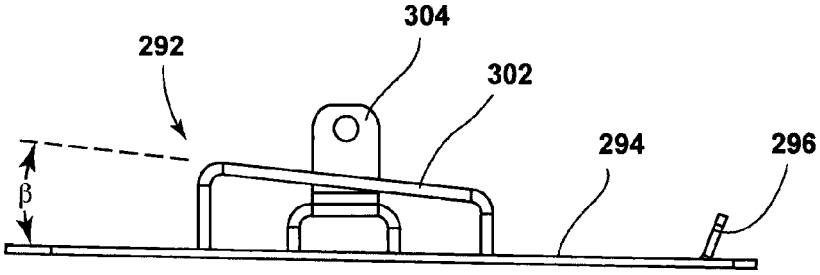
FIG. 38 is a side elevational view of the roller wheel frame of FIG. 37.

Referring to FIGS. 37 and 38 and again to FIG. 35, roller wheel frame 292 further includes a plurality of apertures 300 used to reduce a weight of the frame. A raised plate member 302 provides fastening base support for roller wheel assembly 282. A bracket 304 connected to seatback plate 294 provides support for catch/release device 270. Plate member 302 is oriented at angle β with respect to seatback plate 294.

Figure 39:
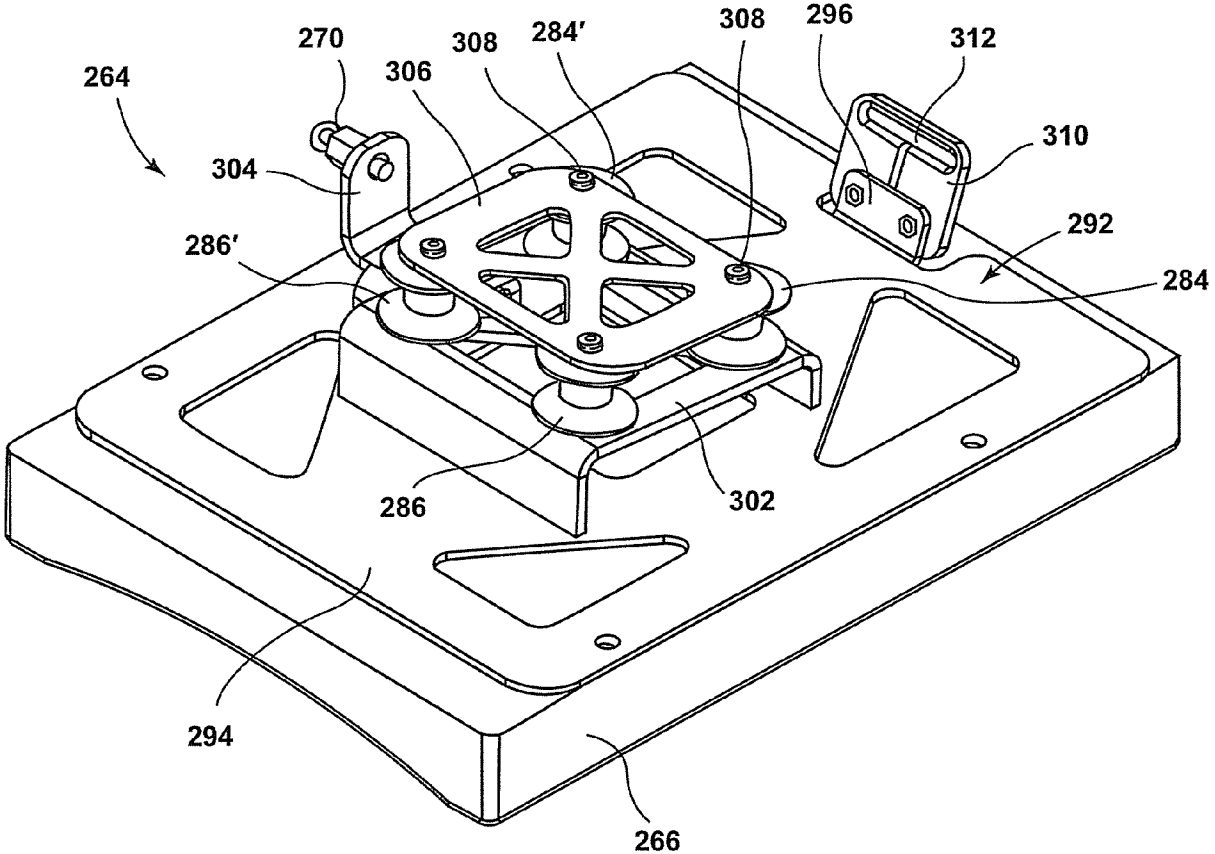
FIG. 39 is a rear perspective view of the seatback assembly of FIG. 31.

Referring to FIG. 39, seatback assembly 264 is completed by connecting seatback plate 294 to seatback pad 266. First and second upper roller wheels 284, 284' and third and fourth lower roller wheels 286, 286' are individually rotatably connected to plate member 302 and to a joining plate 306 using fasteners 308. Joining plate 306 maintains a spacing between each of the first and second upper roller wheels 284, 284' and third and fourth lower roller wheels 286, 286'. A guide member 310 having a guide slot 312 is connected for example by fastening to upper frame member 296. Catch/release device 270 is also connected to bracket 304 when completing seat-back assembly 264.

Figure 40:
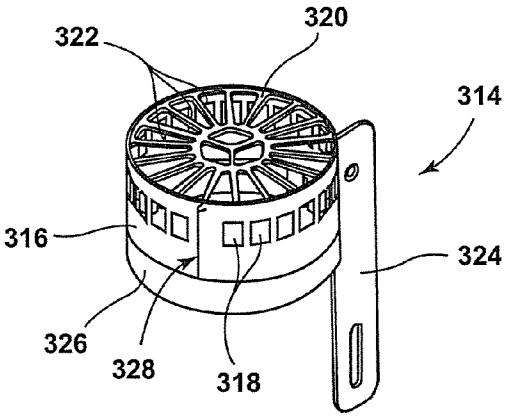
FIG. 40 is a front left perspective view of an exhaust pipe cover assembly of the present disclosure.
Figure 41:
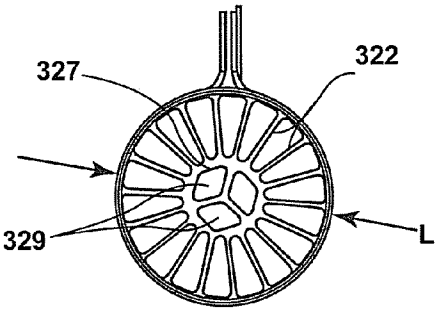
FIG. 41 is a top plan view of the exhaust pipe cover assembly of FIG. 40.
Figure 42:
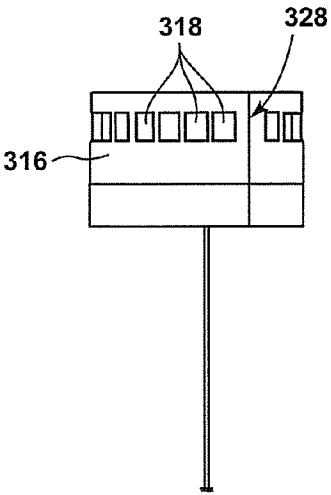
FIG. 42 is a front elevational view of the exhaust pipe cover assembly of FIG. 40.

Referring to FIGS. 40-42, a vehicle exhaust pipe cover assembly 314 that protects against entry of foreign objects into an exhaust pipe includes a cover tube 316 having a plurality of apertures 318 to permit exhaust gas emission in a direction perpendicular to a normal axial flow of exhaust gas. An end cap 320 includes a plurality of radial fingers 322. A mounting arm 324 is connected to cover tube 316 using a mounting band 326. Radial fingers 322 extend radially outward from a central member which can also include other geometrically shaped apertures 329. Cover tube 316 can have a predetermined diameter "L" to suit a known exhaust pipe diameter, or cover tube 316 can be formed from a strip of material having an overlapping joint 328 at the overlapped material. Each of the apertures 318 are preferably equally spaced with respect to successive ones of the apertures 318.

Figure 43:
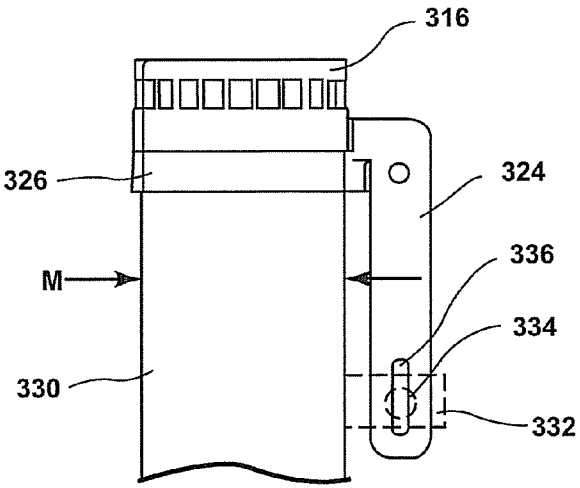
FIG. 43 is a side elevational view of the exhaust pipe cover assembly of FIG. 40.

Referring to FIG. 43, exhaust pipe cover assembly 314 can be employed by mounting on a free end of an exhaust pipe 330 having at least the portion of cover tube 316 covered by the width of mounting band 326 extending into cover tube 316. According to other embodiments, the diameter "L" of cover tube 316 can be equal to or less than a diameter "M" of exhaust pipe 330 such that mounting band 326 can be extended to cover both cover tube 316 and exhaust pipe 330, or a portion of cover tube 316 can be inserted into exhaust pipe 330. To further connect cover tube 316 to exhaust pipe 330, a flange 332 extending from exhaust pipe 330 can be mounted using a fastener 334 extending through flange 332 and through an elongated slot 336 of mounting arm 324.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A cargo loading rail system for a vehicle, comprising:

first and second step mounted rail portions each connected to a door rotatably connected to a vehicle, the door rotatable between each of a fully closed and a fully open condition; and at least one trolley member movable on each of the first and second step mounted rail portions, the at least one trolley member having a cavity receiving one of a plurality of support posts of a member to be loaded into the vehicle by movement of the at least one trolley member on the first and second step mounted rail portions.

2. The cargo loading rail system for a vehicle of claim 1, further including first and second inner vehicle rail portions connected to internal structure of the vehicle and oriented parallel to each other.

3. The cargo loading rail system for a vehicle of claim 2, further including first and second connecting rail portions individually having a rotatable connecting joint to rotatably connect the first and second connecting rail portions to one of the first and second inner vehicle rail portions.

4. The cargo loading rail system for a vehicle of claim 3, further including:

a longitudinal slot created in each of the first and second step mounted rail portions; and a roller fitting assembly connected to each of the first and second connecting rail portions positioned opposite to the connecting joint, the roller fitting assembly slidably received in the longitudinal slot of each of the first and second step mounted rail portions permitting the step mounted rail portions to rotate together with the door between each of the fully closed and the fully open conditions.

5. The cargo loading rail system for a vehicle of claim 3, further including a sliding connection end of each of the first and second connecting rail portions slidably connected to each of the first and second step mounted rail portions.

6. The cargo loading rail system for a vehicle of claim 1, wherein the at least one trolley member includes first and second trolley members movable on each of the first and second step mounted rail portions.

7. The cargo loading rail system for a vehicle of claim 6, wherein the member to be loaded into the vehicle comprises a litter and the plurality of support posts include:

a first litter support post inserted downwardly into the cavity of the first trolley member and thereafter supported by the first trolley member;

a second litter support post aligned with and inserted downwardly into the cavity of the second trolley member, such that displacement of the litter in a loading direction thereafter moves the first and second trolley members and the litter into a vehicle cargo bay.

8. The cargo loading rail system for a vehicle of claim 6, further including:

a rail guide mechanism connected to the first and second trolley members preventing the first and second trolley members from lifting off the continuous rail surfaces of the cargo loading rail system during use;

each of the first and second inner vehicle rail portions are identical and include a semicircular tubular portion fixed to a bracket leg; and the bracket leg bifurcates the semicircular tubular portion such that rounded perimeter portions of the semicircular tubular portion are provided on opposite sides of the continuous bracket leg allowing continuous contact of the rail guide mechanism on a first side of the semicircular tubular portion at any position of the trolley member, and further allowing continuous rolling contact of a set of roller wheels of the trolley member on a second side of the semicircular tubular portion at any position of the trolley member.

9. The cargo loading rail system for a vehicle of claim 1, wherein each of the first and second step mounted rail portions further includes a longitudinal slot slidably receiving a roller fitting assembly.

10. The cargo loading rail system for a vehicle of claim 1, further including a continuous rail surface created when the door is in the fully open condition having ends of first and second connecting rail portions in contact with ends of the step mounted rail portions, and opposite ends of the first and second connecting rail portions in contact with first and second inner vehicle rail portions connected to internal structure of the vehicle.

11. The cargo loading rail system for a vehicle of claim 1, wherein the at least one trolley member includes:

mirror image first and second side plates having a first rolled edge and a second rolled edge; and a cup-shaped member received between the first and second side plates which includes third and fourth rolled edges which are oppositely directed with respect to the first and second rolled edges, the first, second, third, and fourth rolled edges together defining an entrance of the trolley cavity.

12. A cargo loading rail system for a vehicle, comprising:

first and second inner vehicle rail portions connected to structure of a vehicle and oriented parallel to each other;

first and second connecting rail portions individually having a rotatable connecting joint to rotatably connect the first and second connecting rail portions to one of the first and second inner vehicle rail portions;

first and second step mounted rail portions each connected to a door rotatably connected to the vehicle, the door rotatable between each of a fully closed and a fully open condition, each of the first and second step mounted rail portions further having a longitudinal slot; and at least one wheeled trolley member movable on a continuous rail surface created when the door is in the fully open condition having ends of the first and second connecting rail portions in contact with first ends of the first and second connecting rail portions, and second ends of the first and second connecting rail portions in contact with ends of the step mounted rail portions, the at least one trolley member having a cavity receiving a support post of a member to be loaded into the vehicle by movement of the at least one trolley member on the continuous rail surface.

13. The cargo loading rail system for a vehicle of claim 12, further including a roller fitting assembly connected to each of the first and second connecting rail portions positioned opposite to the connecting joint, the roller fitting assembly slidably received in the longitudinal slot of each of the first and second step mounted rail portions.

14. The cargo loading rail system for a vehicle of claim 12, wherein the roller fitting assembly includes:

a bar-shaped body having an aperture proximate one end thereof; and the aperture is sized to be rotatably engaged on a non-threaded shank portion of a fastener rotatably connecting the roller fitting assembly to a connecting mechanism of the first and second connecting rail portions.

15. The cargo loading rail system for a vehicle of claim 12, further including:

a roller fitting assembly connected to each of the first and second connecting rail portions positioned opposite to the connecting joint, the roller fitting assembly slidably received in the longitudinal slot of each of the first and second step mounted rail portions permitting the step mounted rail portions to rotate together with the door between each of the fully closed and the fully open conditions; and a roller member of the roller fitting assembly having a convex outer surface to provide for self-alignment of the roller member as the roller member moves within an inner cavity of the semicircular tube portion.

16. A method for loading a litter into a vehicle using a cargo loading rail system, the cargo loading rail system having first and second inner vehicle rail portions connected to structure of the vehicle, first and second connecting rail portions individually having a rotatable connecting joint to rotatably connect the first and second connecting rail portions to one of the first and second inner vehicle rail portions, first and second step mounted rail portions each connected to a door rotatably connected to the vehicle, and first and second trolley members, the method comprising:

inserting a first litter support post of the litter downwardly into a first trolley cavity of the first trolley member;

pushing the litter in a loading direction thereby transferring a pushing force through the first litter support post to the first trolley member; and continuing to use the rolling force to roll the first trolley member on the first step mounted rail portion until the first trolley member rolls onto the first connecting rail portion.

17. The method of claim 16, further including:

downwardly inserting a second litter support post of the litter into a second trolley cavity of the second trolley member; and continuing to displace the litter in the loading direction to thereafter move the second trolley member and the litter onto the first inner vehicle rail portion in a vehicle cargo bay of the vehicle.

* * * * *